US012262821B2

(12) United States Patent
Morgan

(10) Patent No.: US 12,262,821 B2
(45) Date of Patent: Apr. 1, 2025

(54) ADJUSTABLE BREATH GUARD

(71) Applicant: The Vollrath Company, L.L.C., Sheboygan, WI (US)

(72) Inventor: Steven P. Morgan, Plymouth, WI (US)

(73) Assignee: The Vollrath Company, L.L.C., Sheboygan, WI (US)

( * ) Notice: Subject to any disclaimer, the term of this patent is extended or adjusted under 35 U.S.C. 154(b) by 524 days.

(21) Appl. No.: 17/561,293

(22) Filed: Dec. 23, 2021

(65) Prior Publication Data

US 2023/0200568 A1 Jun. 29, 2023

(51) Int. Cl.
*A47F 10/06* (2006.01)

(52) U.S. Cl.
CPC ..... *A47F 10/06* (2013.01); *A47F 2010/065* (2013.01)

(58) Field of Classification Search
CPC ..... A47F 10/06; A47F 2010/065
USPC ..... 312/137
See application file for complete search history.

(56) References Cited

U.S. PATENT DOCUMENTS

| | | | |
|---|---|---|---|
| 443,350 | A | 12/1890 | Barners |
| 827,950 | A | 8/1906 | Zimmer |
| 1,023,789 | A | 4/1912 | Miller |
| 1,075,334 | A | 10/1913 | Cobb |
| 1,288,665 | A | 12/1918 | Page |
| 1,358,262 | A | 11/1920 | Sumner |
| 1,431,371 | A | 10/1922 | Chapman |
| 1,644,675 | A | 12/1925 | Huening |
| 1,705,237 | A | 3/1929 | Bulman |
| 1,725,867 | A | 8/1929 | Kennedy |
| 2,767,003 | A | 10/1956 | Gilmont |
| 3,426,993 | A | 2/1969 | Johansson |
| 3,554,416 | A | 1/1971 | Bott |
| 3,561,713 | A | 2/1971 | Berkowitz |
| 3,795,379 | A | 3/1974 | Gray |
| 3,921,539 | A | 11/1975 | Berger |
| 4,216,844 | A | 8/1980 | Klafs |
| 4,230,414 | A | 10/1980 | Cheshire |
| 4,448,337 | A | 5/1984 | Harlow et al. |
| 4,469,261 | A | 9/1984 | Stapleton et al. |

(Continued)

FOREIGN PATENT DOCUMENTS

| | | |
|---|---|---|
| CA | 2153439 | 1/1996 |
| CN | 204704255 | 10/2015 |

(Continued)

OTHER PUBLICATIONS

BSI—Deco Engineered Food Shields Model: DECO-250-N.

(Continued)

*Primary Examiner* — James O Hansen
(74) *Attorney, Agent, or Firm* — Foley & Lardner LLP

(57) ABSTRACT

An adjustable breath guard includes a frame, a shield, and a hinge assembly pivotally coupling the shield to the frame. The hinge assembly is reconfigurable between (a) an engaged configuration in which the hinge assembly limits downward movement of the shield and permits upward movement of the shield and (b) a disengaged configuration in which the shield permits both downward movement of the shield and upward movement of the shield. The hinge assembly is configured to change from the engaged configuration to the disengaged configuration in response to the shield moving upward.

11 Claims, 26 Drawing Sheets

(56) References Cited

U.S. PATENT DOCUMENTS

| | | | |
|---|---|---|---|
| 4,500,020 | A | 2/1985 | Rasor |
| 4,506,408 | A | 3/1985 | Brown |
| 4,608,773 | A | 9/1986 | White |
| 4,658,983 | A | 4/1987 | Suttles |
| 4,660,885 | A | 4/1987 | Suhr et al. |
| 4,662,114 | A | 5/1987 | Suttles |
| D293,985 | S | 2/1988 | White |
| 4,757,769 | A | 7/1988 | Suttles |
| D297,490 | S | 9/1988 | Suttles |
| 4,773,543 | A | 9/1988 | Suttles et al. |
| D298,596 | S | 11/1988 | Suttles |
| 4,829,611 | A | 5/1989 | Fireman et al. |
| D301,665 | S | 6/1989 | Suttles |
| D302,221 | S | 7/1989 | Suttles et al. |
| 4,852,954 | A | 8/1989 | Brown et al. |
| D303,190 | S | 9/1989 | Suttles |
| D304,535 | S | 11/1989 | White |
| 4,881,660 | A | 11/1989 | Suttles |
| 4,909,491 | A | 3/1990 | Cheng |
| 4,915,334 | A | 4/1990 | White |
| D309,540 | S | 7/1990 | Suttles et al. |
| D311,837 | S | 11/1990 | Suttles |
| D314,876 | S | 2/1991 | Suttles |
| D324,737 | S | 3/1992 | Stafford |
| D337,462 | S | 7/1993 | Lavaute et al. |
| 5,664,268 | A | 9/1997 | Stoler et al. |
| 5,699,614 | A | 12/1997 | Garneau, Sr. |
| 5,749,480 | A | 5/1998 | Wood |
| 6,115,921 | A | 9/2000 | Garneau, Sr. |
| 6,132,018 | A | 10/2000 | Mcgrath |
| 6,267,111 | B1 | 7/2001 | Burton |
| 6,290,025 | B1 | 9/2001 | Lynn et al. |
| 6,343,406 | B1 | 2/2002 | Yeh |
| 6,390,424 | B1 | 5/2002 | Kidushim et al. |
| 6,421,921 | B1 | 7/2002 | Garneau, Sr. |
| 6,485,118 | B2 | 11/2002 | Matus, Jr. |
| D472,083 | S | 3/2003 | English et al. |
| 6,588,863 | B1 | 7/2003 | Yatchak et al. |
| 6,612,124 | B1 | 9/2003 | Hatch et al. |
| D497,739 | S | 11/2004 | English et al. |
| 7,040,723 | B2 | 5/2006 | Matus, Jr. |
| 7,067,773 | B2 | 6/2006 | Dewitt |
| 7,210,742 | B2 | 5/2007 | Wu |
| D543,780 | S | 6/2007 | Myers et al. |
| D575,560 | S | 8/2008 | English |
| 7,631,575 | B2 | 12/2009 | Gard et al. |
| 7,640,696 | B2 | 1/2010 | Yingst |
| 7,784,398 | B2 | 8/2010 | Matus, Jr. |
| 7,895,953 | B2 | 3/2011 | Matus, Jr. |
| 7,958,673 | B2 | 6/2011 | Yingst et al. |
| D649,865 | S | 12/2011 | English et al. |
| 8,109,579 | B2 | 2/2012 | English et al. |
| 8,112,920 | B2 | 2/2012 | Fenton |
| 8,128,306 | B2 | 3/2012 | Gorza |
| 8,302,919 | B1 | 11/2012 | Mcgrath |
| 8,308,249 | B2 | 11/2012 | Matus, Jr. |
| 8,403,430 | B2 | 3/2013 | Atkins |
| 8,544,112 | B2 | 10/2013 | Gosine |
| 8,585,160 | B2 | 11/2013 | Atkins |
| 8,671,618 | B2 | 3/2014 | Yingst et al. |
| 8,701,323 | B2 | 4/2014 | Fenton |
| 8,898,862 | B1 | 12/2014 | Mcgrath |
| 8,925,153 | B1 | 1/2015 | Mcgrath |
| 8,925,172 | B2 | 1/2015 | English |
| 8,973,876 | B1 | 3/2015 | Mcgrath |
| 9,010,883 | B2 | 4/2015 | Scott |
| 9,062,483 | B1 | 6/2015 | Mcgrath |
| 9,144,329 | B1 | 9/2015 | Mcgrath |
| 9,153,147 | B2 | 10/2015 | Fenton |
| 9,161,639 | B1 | 10/2015 | Hundley et al. |
| 9,249,827 | B2 | 2/2016 | Serocki et al. |
| 9,291,188 | B2 | 3/2016 | English |
| D756,759 | S | 5/2016 | Atkins et al. |
| 9,326,621 | B1 | 5/2016 | Mcallister et al. |
| 9,339,131 | B1 | 5/2016 | Christianson |
| 9,399,882 | B1 | 7/2016 | Mcgrath |
| 9,516,958 | B1 | 12/2016 | Mcallister et al. |
| 9,538,868 | B1 | 1/2017 | Christianson |
| 9,557,004 | B1 | 1/2017 | Mcgrath |
| 9,723,935 | B1 | 8/2017 | Mcallister et al. |
| 9,777,521 | B2 | 10/2017 | Edavana et al. |
| 9,782,022 | B2 | 10/2017 | Atkins et al. |
| 9,839,306 | B2 | 12/2017 | Atkins et al. |
| 10,024,090 | B2 | 7/2018 | Tazbaz et al. |
| 10,047,789 | B1 | 8/2018 | Mosby et al. |
| 10,058,198 | B2 | 8/2018 | Atkins et al. |
| 10,058,199 | B1 | 8/2018 | Perry |
| 10,100,571 | B2 | 10/2018 | Deman |
| 10,102,780 | B2 | 10/2018 | Fenton |
| 10,159,363 | B1 | 12/2018 | Mcallister et al. |
| 10,174,534 | B2 | 1/2019 | Tazbaz et al. |
| 10,180,022 | B1 | 1/2019 | Garg et al. |
| 10,223,985 | B2 | 3/2019 | Staton et al. |
| 10,292,506 | B2 | 5/2019 | Matus, Jr. |
| 10,405,677 | B2 | 9/2019 | Cummings et al. |
| 10,413,097 | B2 | 9/2019 | Matus, Jr. |
| 10,415,285 | B1 | 9/2019 | Anderson et al. |
| 10,546,517 | B2 | 1/2020 | Fenton |
| 10,750,887 | B2 | 8/2020 | Atkins et al. |
| 10,765,236 | B2 | 9/2020 | Quinter et al. |
| 10,767,405 | B1 | 9/2020 | Anderson et al. |
| 10,799,043 | B2 | 10/2020 | Quinter |
| 10,818,250 | B2 | 10/2020 | Staton et al. |
| 10,986,943 | B2 | 4/2021 | Quinter |
| 11,129,484 | B2 | 9/2021 | Scott |
| 2002/0096976 | A1 | 7/2002 | Matus |
| 2003/0047086 | A1 | 3/2003 | Matus, Jr. |
| 2003/0057810 | A1 | 3/2003 | Dewitt |
| 2004/0226903 | A1 | 11/2004 | Wang |
| 2005/0061585 | A1 | 3/2005 | Yingst |
| 2006/0163976 | A1 | 7/2006 | Matus, Jr. |
| 2006/0175940 | A1 | 8/2006 | English |
| 2006/0192467 | A1 | 8/2006 | Matus, Jr. |
| 2007/0236112 | A1 | 10/2007 | Williman |
| 2009/0224583 | A1 | 9/2009 | Nagura et al. |
| 2010/0045149 | A1 | 2/2010 | English et al. |
| 2011/0080075 | A1 | 4/2011 | Matus, Jr. |
| 2011/0169384 | A1 | 7/2011 | Padden et al. |
| 2012/0200207 | A1 | 8/2012 | Atkins |
| 2014/0366751 | A1 | 12/2014 | Atkins et al. |
| 2015/0289641 | A1 | 10/2015 | Ergun et al. |
| 2016/0073795 | A1 | 3/2016 | Matus, Jr. |
| 2016/0331155 | A1 | 11/2016 | Atkins et al. |
| 2018/0242760 | A1 | 8/2018 | Cummings et al. |
| 2019/0110588 | A1 | 4/2019 | Wong |
| 2019/0110613 | A1 | 4/2019 | Charlier et al. |
| 2019/0110614 | A1 | 4/2019 | Charlier et al. |
| 2019/0128034 | A1 | 5/2019 | Luedtke |
| 2019/0150640 | A1 | 5/2019 | Scott |
| 2019/0350386 | A1 | 11/2019 | Cummings et al. |
| 2020/0046146 | A1 | 2/2020 | Hansen |
| 2020/0245787 | A1* | 8/2020 | Quinter ..... F16C 11/0609 |
| 2020/0245789 | A1 | 8/2020 | Hansen |

FOREIGN PATENT DOCUMENTS

| | | |
|---|---|---|
| DE | 10320528.2 | 12/2004 |
| DE | 10320528 A1 | 12/2004 |
| FR | 2504216 B3 | 2/1984 |
| JP | 2007-159882 A | 6/2007 |
| JP | 2011-012750 A | 1/2011 |

OTHER PUBLICATIONS

BSI Designs: Food Guards, http://www.bsidesigns.com/products/food-guards, viewed Jun. 14, 2018, 2 pgs.

BSI: Deco Engineered Food Shields, Model: DECO-250-N, Apr. 30, 2017 (Apr. 30, 2017), XP055544067, Retrieved from the Internet: URL:https://assetcloud.roccommerce.net//files/_singer/4/10/8/10004447_spec_sheet.pdf.

Foreign Action other than Search Report on PCT PCT/US2018/000384 Dtd Apr. 30, 2020.

(56) References Cited

OTHER PUBLICATIONS

International Search Report and Written Opinion of the International Searching Authority for PCT/US2018/000384 dated Jan. 28, 2019.
Mark Johnsn, Workshop, Finer Futon Frame, Not just for dorm rooms anymore, Handy, Mar./Apr. 2002, viewed Dec. 9, 2014, pp. 10 and 12-16.
PMG Premier Metal & Glass, Self Serve Sneeze Guards, https://www.pmg-inc./self-serve-sneeze-guards, viewed Jun. 14, 2018, 1 pg.
Stepless adjustment for angular position 2, https://www.youtube.com/watch?v =-ip9PIJ7z5Q uploaded on Jun. 19, 2019, 23 pages.
Versa Gard, Food Protection System, Sneeze Guards, http://versagard.com, viewed Jun. 14, 2018, 1 pg.
Woodsmith Plans, Designer Series Project, Craftsman-style Futon Sofa Bed, WoodsmithPlans.com (WS15226), Aug. 2012 Home Publishing Co., pp. 1-8.

* cited by examiner

ADJUSTABLE BREATH GUARD

BACKGROUND

The present disclosure relates generally to food serving systems. More specifically, the present disclosure relates to breath guards for food serving systems.

SUMMARY

At least one embodiment relates to an adjustable breath guard including a frame, a shield, and a hinge assembly pivotally coupling the shield to the frame. The hinge assembly is reconfigurable between (a) an engaged configuration in which the hinge assembly limits downward movement of the shield and permits upward movement of the shield and (b) a disengaged configuration in which the shield permits both downward movement of the shield and upward movement of the shield. The hinge assembly is configured to change from the engaged configuration to the disengaged configuration in response to the shield moving upward.

Another embodiment relates to an adjustable breath guard including a frame, a shield, and a hinge assembly pivotally coupling the shield to the frame. The hinge assembly includes a base coupled to one of the frame or the shield, a body coupled to the other of the frame or the shield and pivotally coupled to the base, and a pawl pivotally coupled to the base and repositionable between an extended position and a retracted position. The body defines a ratchet protrusion. The pawl is configured to engage the ratchet protrusion to limit rotation of the body relative to the base in a first rotational direction when the pawl is in the extended position, and wherein the pawl is separated from the ratchet protrusion in the retracted position such that the pawl permits rotation of the body in the first rotational direction.

Another embodiment relates to an adjustable breath guard including a shield, a base defining a shaft passage, a shaft coupled to the shield and received within the shaft passage to slidably couple the shield to the base, and a locking member coupled to the base and selectively repositionable relative to the base between an engaged position and a disengaged position. The shaft defines a plurality of recesses spaced apart along a length of the shaft. The locking member defines a groove. When the locking member is in the engaged position, the locking member is received within one of the recesses of the shaft and limits movement of the shaft along the shaft passage. When the locking member is in the disengaged position, the groove aligns with the shaft passage, and the locking member permits movement of the shaft along the shaft passage.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the figures, a food serving system is shown according to various exemplary embodiments. The food serving system includes a repositionable shield assembly including a pair of hinge assemblies that couple a movable panel to a frame. A first hinge assembly is reconfigurable between an engaged configuration and a disengaged configuration. In the engaged configuration, a cog within the first hinge assembly engages a series of ratchet teeth, permitting free upward rotational movement (e.g., movement in a first rotational direction) of the movable panel and limiting downward rotational movement (e.g., movement in a second rotational direction opposite the first rotational direction) of the movable panel. In the disengaged configuration, a cam plate retracts the cog to permit free upward movement and downward movement of the movable panel. The cam plate reconfigures the first hinge assembly between the engaged and disengaged configurations when the movable panel is near an upper limit position or a lower limit position of the range of motion. A second hinge assembly omits the cog and permits free upward movement and downward movement of the movable panel.

In some embodiments, the movable panel is translatable relative to the hinge assemblies to facilitate further adjustment. Specifically, the movable panel is coupled to a pair of arms that are each slidably received within a passage defined by one of the hinges. Each arm defines a series of recesses that are spaced apart along a length of the arm. A button of each hinge assembly is configured to selectively be received within one of the recesses to prevent the corresponding arm from sliding and hold the movable panel in a corresponding position.

System Overview

Figure 1:
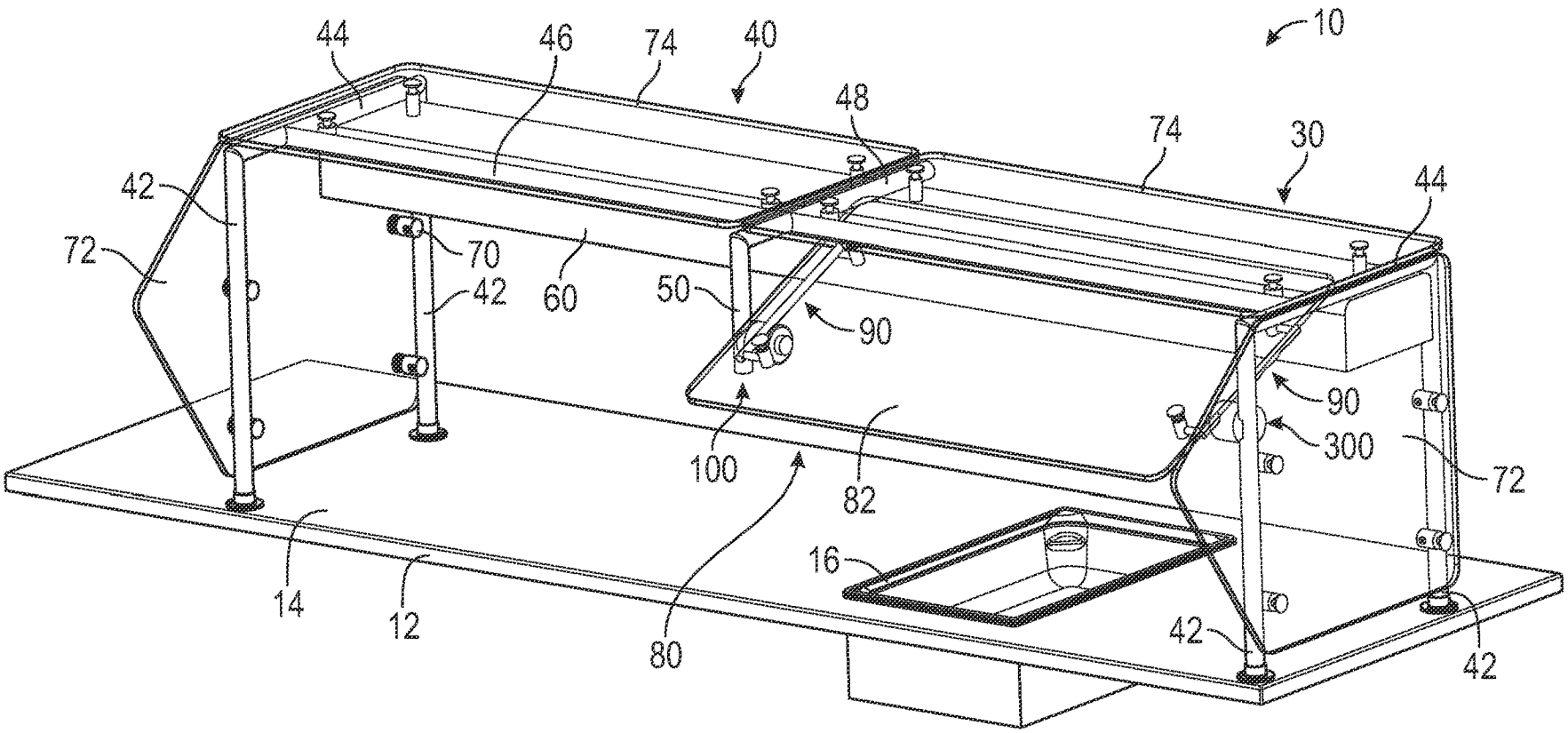
FIGS. 1 and 2 are perspective views of a food serving system including a breath guard having a shield assembly, according to an exemplary embodiment.
Figure 2:
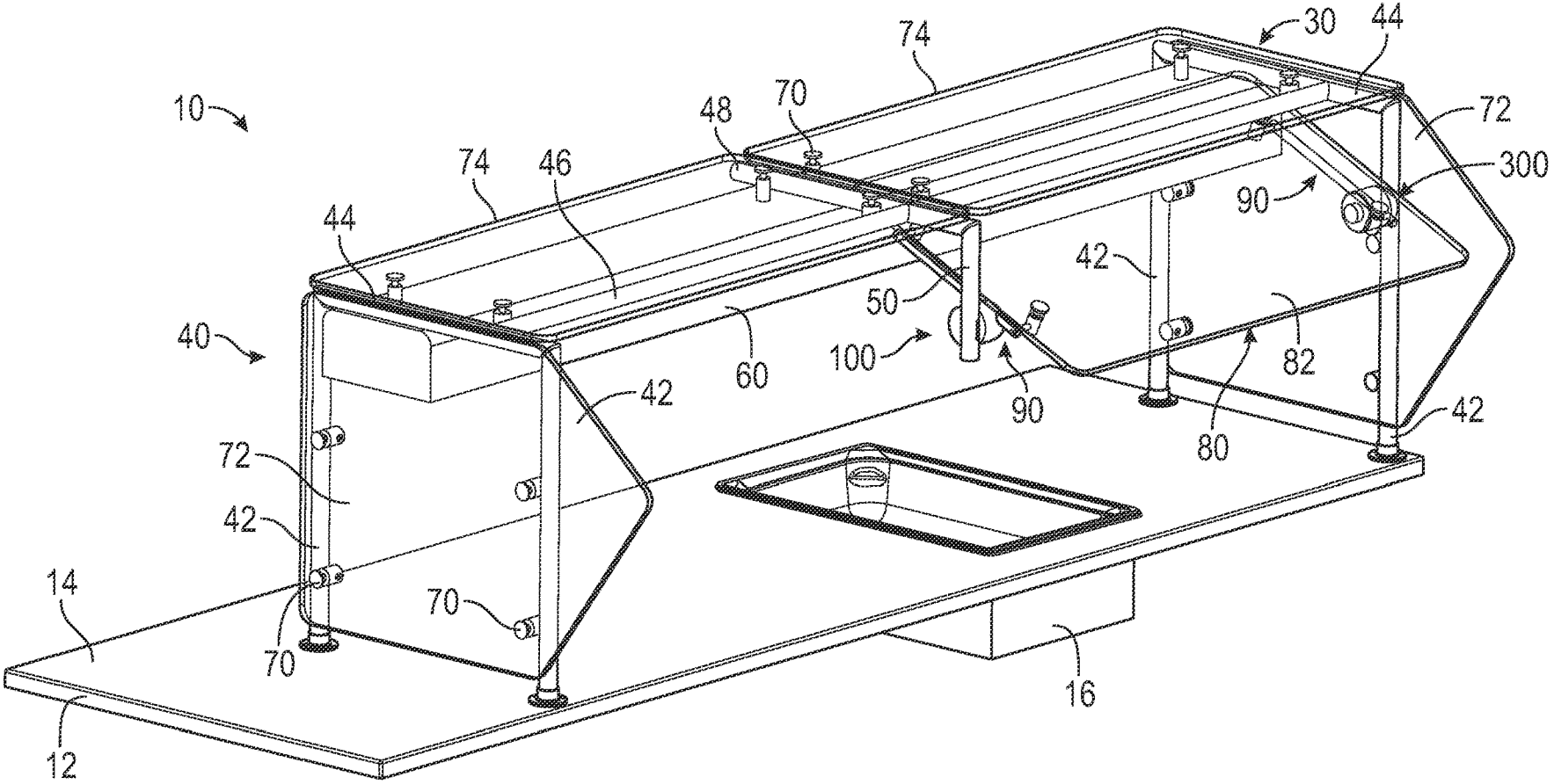

Referring to FIGS. 1 and 2, a food serving system, food storage system, or food display system is shown as system 10 according to an exemplary embodiment. The system 10 includes a base, shown as countertop 12, configured to support one or more food products. The countertop 12 may be part of a mobile food preparation or serving station or may be fixed in place. The countertop 12 defines a food preparation or support surface, shown as top surface 14. The top surface 14 may support food products during preparation or and/or serving. The countertop 12 is further configured to support one or more containers (e.g., dishes, trays, pans, etc.), shown as food pans 16. The food pans 16 may rest upon the top surface 14 of the countertop 12 or extend below the top surface 14. In some embodiments, the top surface 14 of the countertop 12 is located at approximately waist height.

The system 10 includes an adjustable sneeze guard assembly, adjustable breath guard assembly, or food shield assembly, shown as breath guard 30. The breath guard 30 is coupled to the countertop 12 and extends upward from the top surface 14. The breath guard 30 is configured to act as a barrier between one or more users and the countertop 12, protecting the food supported by the countertop 12 and the food held in the food pan 16 from contamination (e.g., from sneezing, from coughing, from breathing, from touching, etc.). The breath guard 30 is configured such that the area covered by the breath guard 30 is adjustable for use in multiple different situations. By way of example, breath guard 30 may be reconfigurable between (a) a first configuration (e.g., a full-service or cafeteria configuration) where the breath guard 30 blocks or otherwise limits access to the countertop 12 from a front side (e.g., customer side) of the system 10 and permits (e.g., allows) access from a rear side (e.g., a staff side) of the system 10 and (b) a second configuration (e.g., a self-service or buffet configuration) where the breath guard 30 permits access from both the front side and the rear side.

The breath guard 30 includes a frame assembly or support assembly, shown as frame 40. In some embodiments, the frame 40 includes a series of tubular members, segments, or sections that are fixedly coupled to one another (e.g., welded together as a weldment) to form the complete frame 40. The frame 40 is coupled to the countertop 12 and supports the other components of the breath guard 30. The frame 40 includes a series of upright or vertical members 42. The vertical members 42 are coupled to the countertop 12 and extend upward (e.g., vertically) from the countertop 12. A pair of longitudinal members 44 are positioned on opposite sides of the breath guard 30. Each longitudinal member 44 extends longitudinally between and is coupled to the top end of one vertical member 42 and the top end of another vertical member 42, forming a U-shaped subframe. One U-shaped subframe is positioned at each of the left end and the right end of the frame 40. A lateral member 46 is coupled to and extends laterally between the longitudinal members 44. A longitudinal member 48 is coupled to the lateral member 46 between the longitudinal members 44 (e.g., centered between the longitudinal members 44). The longitudinal member 48 extends forward and rearward from the lateral member 46. A vertical member 50 is coupled to a front end of the longitudinal member 48. The vertical member 50 extends downward from the longitudinal member 48. In some embodiments, two of the vertical members 42 and the vertical member 50 are positioned within a common vertical plane.

In some embodiments, the frame 40 is coupled to and supports an accessory 60. The accessory 60 may include one or more functional components such as lights, heating elements (e.g., heat strips, heat lamps, etc.), fans, or other components. As shown, the accessory 60 extends laterally across the width of the breath guard 30. The accessory 60 hangs downward from the longitudinal members 44 and 48. In other embodiments, the accessory 60 is omitted.

The breath guard 30 further includes a series of fixed panels, panes, or shields that are coupled to the frame 40. The fixed panels may be made from a transparent or translucent material, such as glass, polycarbonate, or acrylic, to facilitate a minimally obstructed view of the countertop 12. The fixed panels may be fixedly coupled to the frame 40 such that the fixed panels are stationary relative to the frame 40. The fixed panels are each coupled to the frame 40 with a series of couplers or adapters, shown as panel couplers 70. Each panel coupler 70 includes a body that is fastened to one of the frame members of the frame 40. The body may define a circular recess that receives the corresponding frame member, limiting rotation of the body relative to the corresponding frame member. Each body is in threaded engagement with a fastener or cap. The fixed panel is received between the cap and the body to couple the fixed panel to the panel coupler 70.

Figure 5:
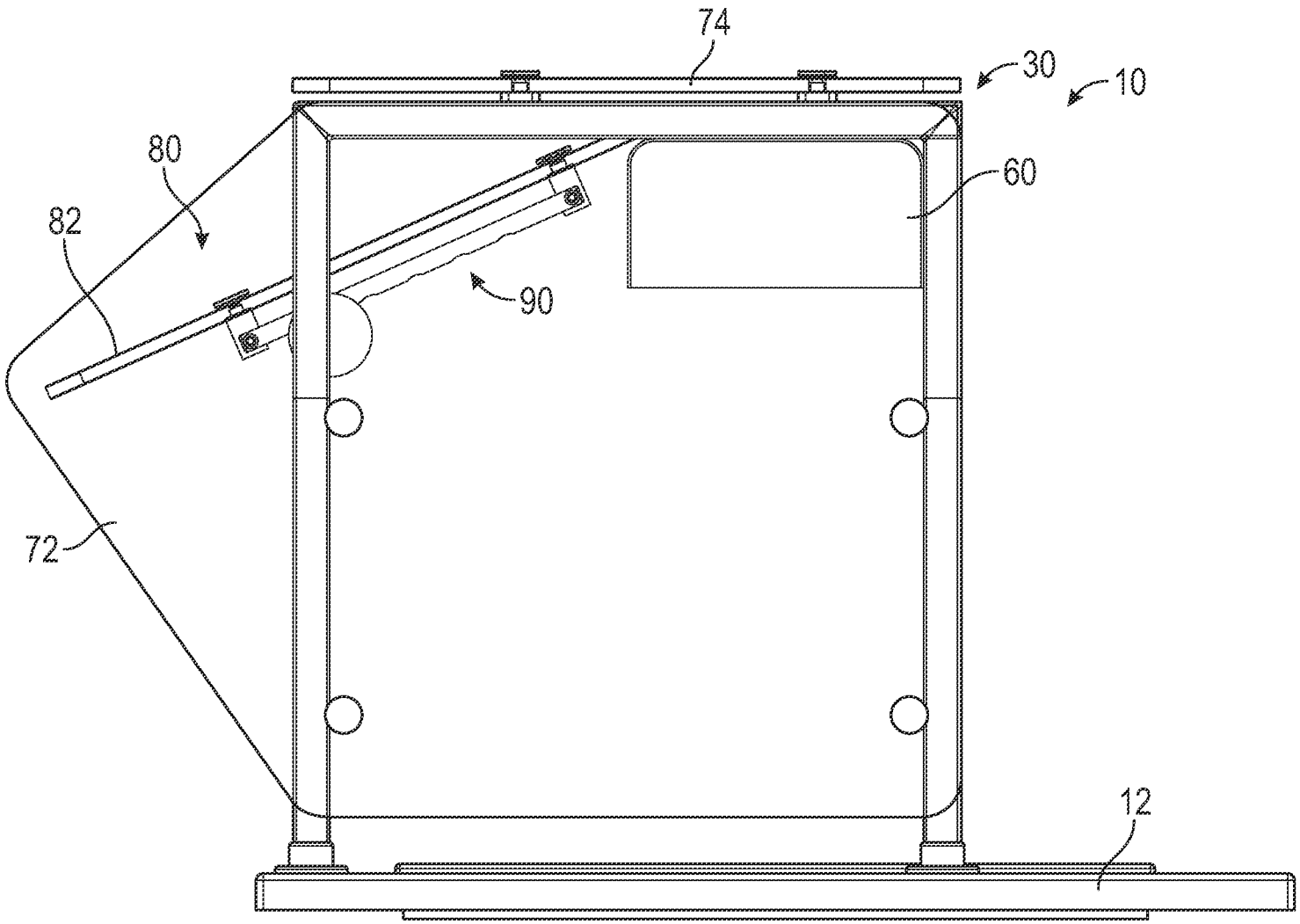
FIG. 5 is a right side view of the breath guard of FIG. 1 with the shield assembly in a buffet configuration, according to an exemplary embodiment.

The breath guard 30 includes a first pair of fixed panels, shown as side panels 72. Each side panel 72 is coupled to a pair of the vertical members 42 by a series of panel couplers 70. One side panel 72 extends within a vertical plane along a left side of the breath guard 30. Another side panel 72 extends within a vertical plane along a right side of the breath guard 30. Each of the side panels 72 may include a triangular protrusion that extends forward to facilitate covering the sides of the movable panel 82 in the buffet configuration (e.g., as shown in FIG. 5).

The breath guard 30 includes a second pair of fixed panels, shown as top panels 74. Each top panel 74 is coupled to one of the longitudinal members 44 and the longitudinal member 47 by a series of panel couplers 70. The top panels 74 extend within a horizontal plane along a top side of the breath guard 30. The top panels 74 may be used as a shelf to store one or more items (e.g., utensils, dishes, condiments, etc.). In other embodiments, the breath guard 30 includes only a single top panel 74 that extends laterally between the longitudinal members 44.

The breath guard 30 further includes movable shield assembly, shown as shield assembly 80, including a movable, adjustable, or repositionable panel, pane, or shield, shown as movable panel 82. The movable panel 82 may be made from a transparent or translucent material, such as glass, polycarbonate, or acrylic, to facilitate a minimally obstructed view of the countertop 12. The shield assembly 80 further includes a first hinge assembly, pivot, coupler, or positioner, shown as ratcheting hinge 100 and a second hinge assembly, pivot, coupler, or positioner, shown as free hinge 300. The ratcheting hinge 100 and free hinge 300 movably (e.g., pivotally and translatably) couple the movable panel 82 to the frame 40. The ratcheting hinge 100 is coupled to a first end of the movable panel 82 and to the vertical member 50. The free hinge 300 is coupled to a second end of the movable panel 82 and to one of the vertical members 42.

Figure 3:
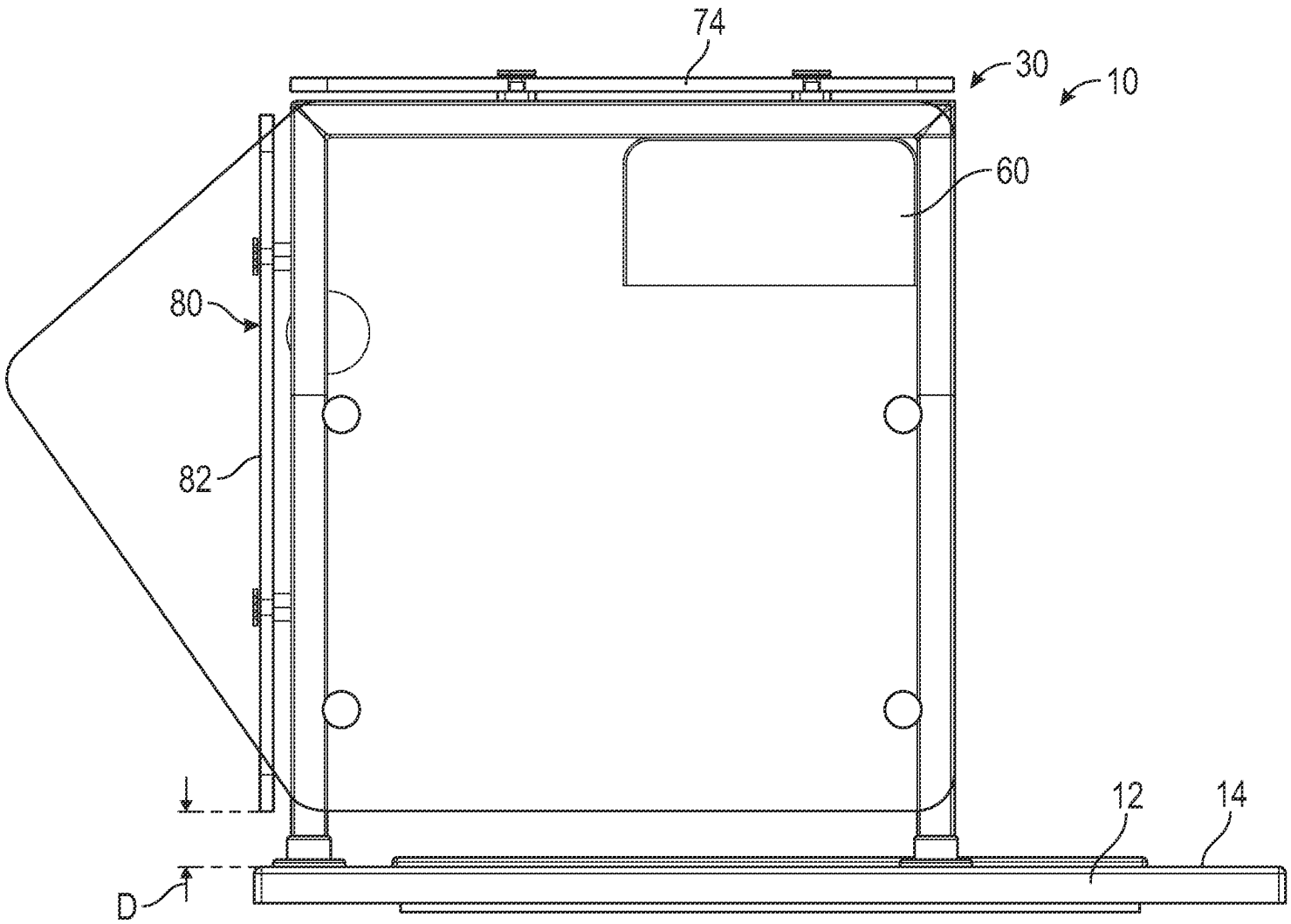
FIG. 3 is a right side view of the breath guard of FIG. 1 with the shield assembly in a cafeteria configuration, according to an exemplary embodiment.
Figure 6:
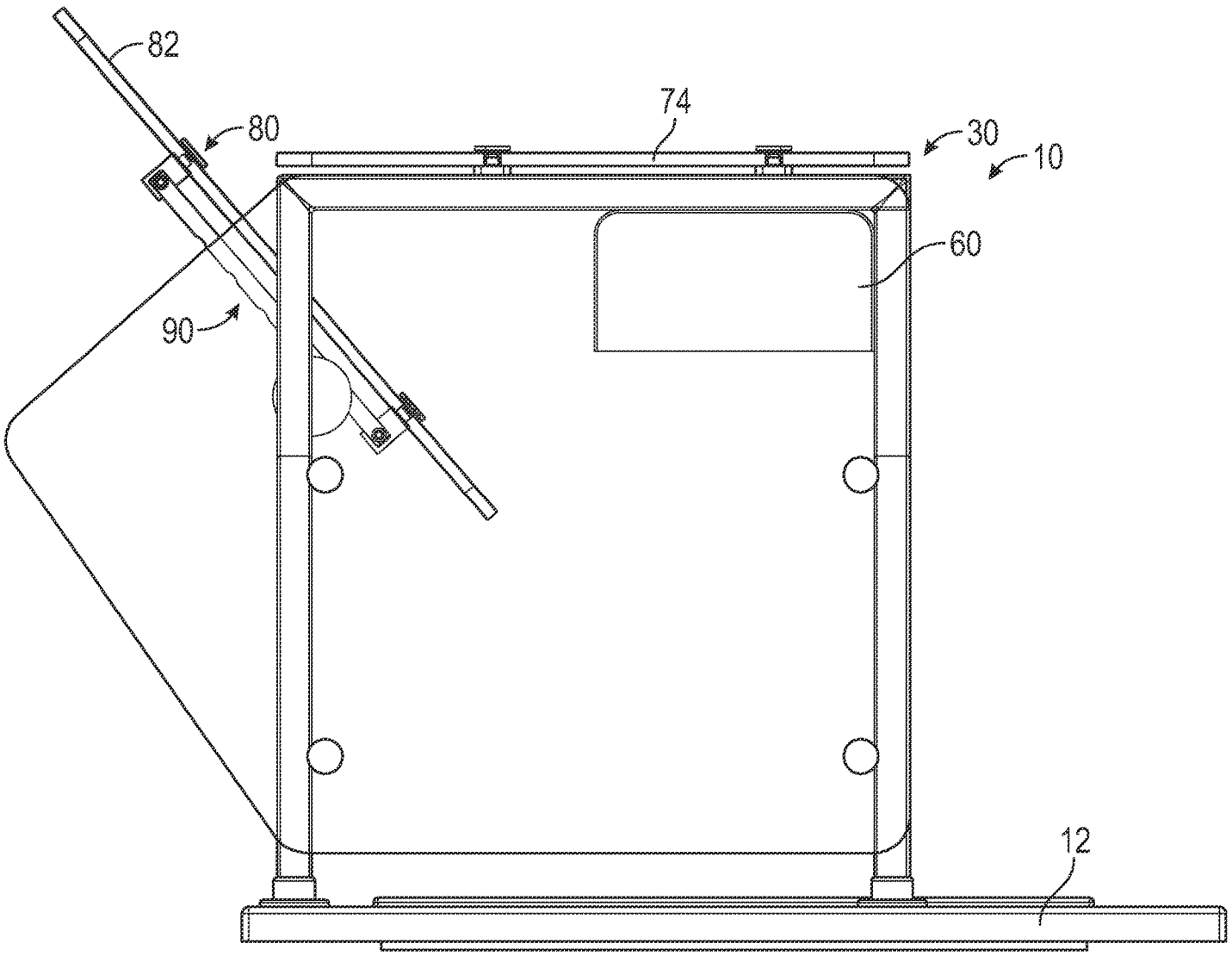
FIG. 6 is a right side view of the breath guard of FIG. 1 with the shield assembly in a release configuration, according to an exemplary embodiment.

Referring to FIGS. 3-7, the movable panel 82 is rotatable throughout a rotational range of motion (e.g., a range of rotational positions or orientations) between a top position or upper limit position (e.g., as shown in FIG. 6) and a bottom position or lower limit position (e.g., as shown in FIG. 3). In some embodiments, the ratcheting hinge 100 and/or the free hinge 300 are configured to prevent movement of the movable panel 82 above or beyond the upper limit position. In some embodiments, the ratcheting hinge 100 and/or the free hinge 300 are configured to prevent movement of the movable panel 82 below or beyond the lower limit position. The ratcheting hinge 100 is configured to control movement of the movable panel 82 throughout the rotational range of motion (i.e., between the upper limit position and the lower limit position). The free hinge 300 may permit free upward and downward movement of the movable panel 82 throughout the rotational range of motion.

In some embodiments, the ratcheting hinge 100 is configured to selectively limit downward movement of the movable panel 82. The ratcheting hinge 100 may be reconfigurable between a ratcheting or engaged configuration and a free or disengaged configuration. In the ratcheting configuration, the ratcheting hinge 100 may limit (e.g., prevent, inhibit, etc.) downward movement of the movable panel 82. By way of example, the ratcheting hinge 100 may be repositionable into a series of discrete positions. When the movable panel 82 is in one of the discrete positions and the ratcheting hinge 100 is in the ratcheting configuration, the ratcheting hinge 100 may prevent the movable panel 82 from moving downward.

The ratcheting hinge 100 may permit free upward movement of the movable panel 82 until the movable panel 82 reaches the upper limit position. When the movable panel 82 reaches a release position or disengagement position (e.g., near the upper limit position), the ratcheting hinge 100 may automatically reconfigure from the ratcheting configuration to the disengaged configuration (e.g., due to the upward force applied to the movable panel 82 by an operator). In the disengaged configuration, the ratcheting hinge 100 permits free upward and downward movement throughout the rotational range of motion. When the movable panel 82 reaches an engagement position (e.g., near the lower limit position), the ratcheting hinge 100 may automatically reconfigure from the disengaged configuration to the ratcheting configuration. Once in the ratcheting configuration, the user may lift the movable panel 82 to a desired one of the discrete positions, and the ratcheting hinge 100 will retain the movable panel 82 in that position until the user again lifts the movable panel 82.

Referring to FIGS. 1, 2, 8, and 9, the shield assembly 80 further includes a pair of translational adjustment assemblies or positioners, shown as positioner assemblies 90, that couple the movable panel 82 to the ratcheting hinge 100 and the free hinge 300, respectively. The positioner assemblies 90 are arranged in a mirrored orientation relative to one another (e.g., are mirror images of one another about a center plane positioned between the ratcheting hinge 100 and the free hinge 300). The positioner assemblies 90 may be substantially similar to one another, except as otherwise specified herein. Accordingly, any description of the positioner assembly 90 that is coupled to the ratcheting hinge 100 may also apply to the positioner assembly 90 that is coupled to the free hinge 300, except as otherwise specified herein.

Figure 8:
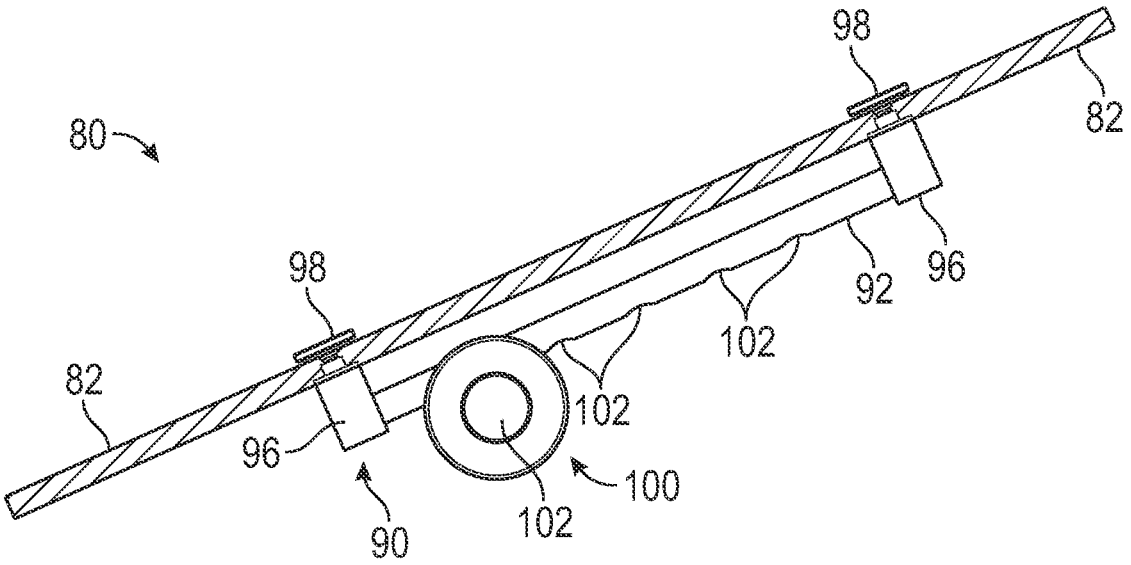
FIG. 8 is a right section view of the shield assembly of FIG. 1.
Figure 9:
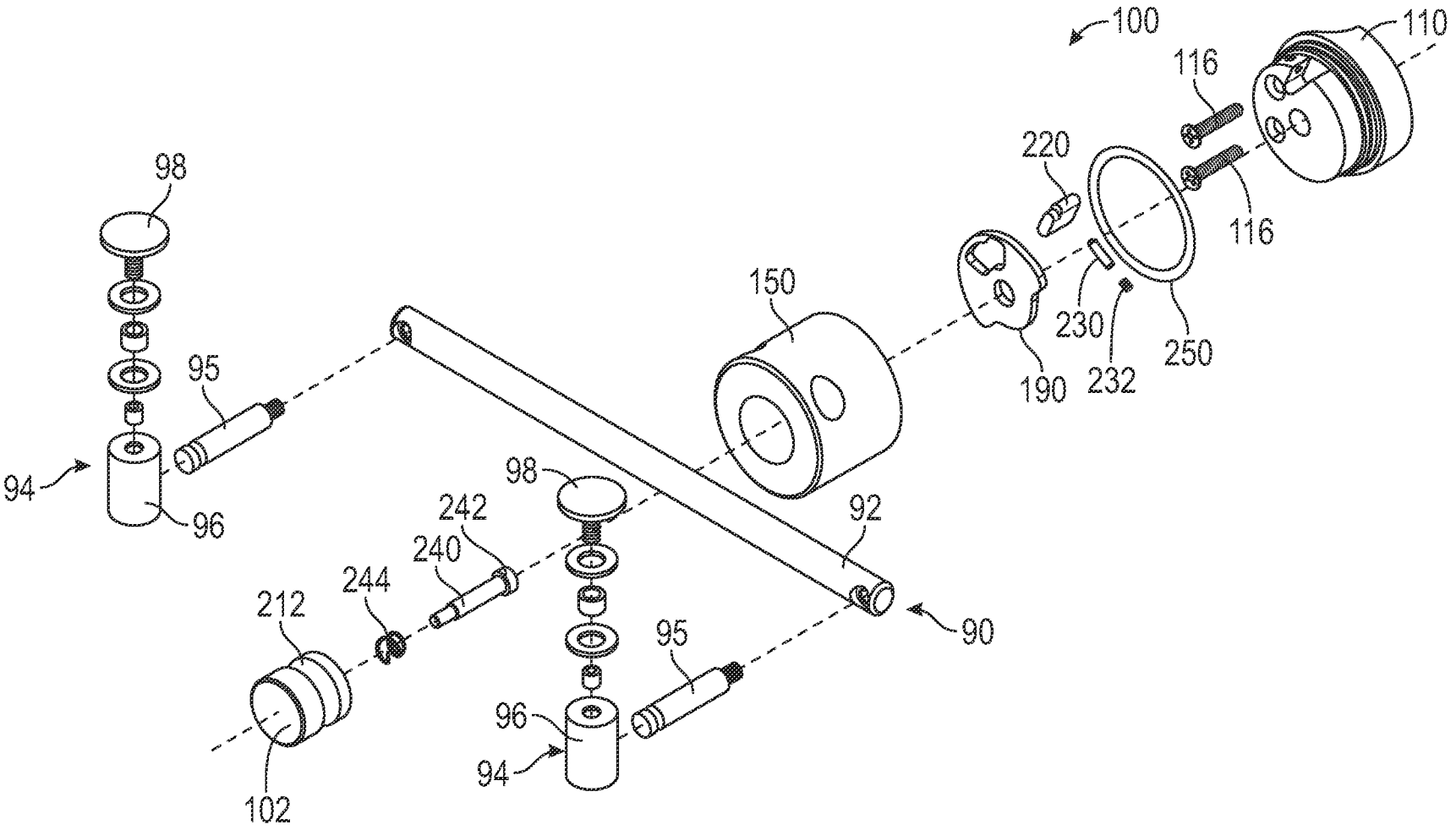
FIG. 9 is an exploded view of a ratcheting hinge assembly and a positioner assembly of the shield assembly of FIG. 1.

Referring to FIGS. 8 and 9, the positioner assembly 90 that is coupled to the ratcheting hinge 100 includes a sliding support bar, shown as arm 92, that is received by and selectively slidably coupled to the ratcheting hinge 100. Each end of the arm 92 is coupled to the movable panel 82 by a pair of standoff assemblies 94. Each standoff assembly 94 includes a first member, shown as standoff arm 95, a second member or standoff body, shown as standoff base 96, and a third member or fastener, shown as standoff cap 98. The standoff arm 95 is coupled to (e.g., by threaded engagement) one of the ends of the arm 92 and extends laterally away from the arm 92. The standoff base 96 receives and is coupled to the end of the standoff arm 95 opposite the arm 92. The standoff base 96 extends upward from the standoff arm 95, separating the movable panel 82 from the ratcheting hinge 100. The standoff cap 98 extends through an aperture defined by the movable panel 82 and is coupled to the standoff base 96. By way of example, the standoff cap 98 may include a threaded portion that is in threaded engagement with the threaded receptacle of the standoff base 96. The standoff cap 98 may be tightened (e.g., by a spanner wrench in engagement with an aperture of the standoff cap 98), clamping the movable panel 82 between the standoff cap 98 and the standoff base 96. Accordingly, the standoff assemblies 94 fixedly and removably couple the arm 92 to the movable panel 82.

The ratcheting hinge 100 includes a user interface member, translational member, lock, or locking member, shown as button 102. The button 102 is configured to be depressed by an operator (e.g., receives a first user input from a user) to move from an extended position (e.g., an engaged position) to a depressed position (e.g., a disengaged position). In some embodiments, the button 102 is biased (e.g., by a spring) toward the extended position (e.g., such that a second user input can be provided by the user releasing the button 102). The arm 92 defines a series of detents, recesses, notches, or cutouts, shown as scoops 104, that are positioned at regular intervals along the length of the arm 92. In the embodiment of FIG. 8, the arm 92 defines five scoops 104. In other embodiments, the arm 92 defines more or fewer (e.g., at least two) scoops 104. When the button 102 is in the extended position, the button 102 is received within one of the scoops 104, limiting (e.g., preventing) translation of the arm 92 relative to the ratcheting hinge 100. When the button 102 is in the depressed position, the button 102 is disengaged from the arm 92, and the arm 92 is free to translate relative to the ratcheting hinge 100 along an axis that extends parallel to the length of the arm 92. Accordingly, the arm 92 is translatably repositionable between a series of discrete positions, each position corresponding to one of the scoops 104. The quantity and location of each position may be varied by changing the quantity and/or locations of the scoops 104.

Similarly, the free hinge 300 includes a user interface member, translational member, or locking member, shown as button 302. The button 302 is configured to be depressed by an operator to move from an extended position to a depressed position. In some embodiments, the button 302 is biased (e.g., by a spring) toward the extended position. Similar to the button 102, the button 302 can be selectively depressed to permit translational movement of the movable panel 82 relative to the free hinge 300.

With the button 102 in the extended position, the button 102 engages the corresponding arm 92 to limit (e.g., prevent) translational (e.g., sliding) movement of the movable panel 82 relative to the ratcheting hinge 100. Similarly, with the button 302 in the extended position, the button 302 engages the corresponding arm 92 to limit (e.g., prevent) translational (e.g., sliding) movement of the movable panel 82 relative to the free hinge 300. Accordingly, with both of the button 102 and the button 302 in their respective extended positions, the movable panel 82 may rotate but not translate.

In some embodiments, the free hinge 300 may be configured to lock or otherwise retain the movable panel 82 in a predetermined rotational position. By way of example, the free hinge 300 may lock the movable panel 82 in the rotational position corresponding to the buffet configuration. The free hinge 300 may release the movable panel 82 to permit free rotation of the movable panel 82 when the button 302 is depressed. The free hinge 300 may automatically lock the movable panel 82 in the predetermined rotational position when the movable panel 82 enters the predetermined rotational position. Alternatively, the lock may be engaged or disengaged manually by a user input. In other embodiments, the free hinge 300 is not capable of locking the movable panel 82.

If a user wishes to adjust the translational position of the movable panel 82, the user depresses both the button 102 and the button 302. With the button 102 and the button 302 in their respective depressed positions, the movable panel 82 slides freely relative to the ratcheting hinge 100 and the free hinge 300. With only one of the button 102 or the button 302 depressed, the movable panel 82 is still held in place. When the user has adjusted the movable panel 82 to the desired translational position, the user may release the button 102 and the button 302, allowing the button 102 and the button 302 to be biased back toward the extended positions. If the button 102 and the button 302 are each aligned with a scoop 104 of the corresponding arm 92, the button 102 and the button 302 each return to the corresponding extended position and again limit translation of the movable panel 82. If the button 102 and the button 302 are not aligned with scoops 104, the user may reposition the movable panel 82 slightly (e.g., by moving the movable panel 82 forward or backward) until the alignment is achieved.

System Operation

FIGS. 3-7 illustrate the movement of the shield assembly 80 throughout an operational cycle, according to an exemplary embodiment. FIG. 3 illustrates the shield assembly 80 in a full-service configuration or cafeteria configuration. The cafeteria configuration may correspond to the lower limit position of the movable panel 82. In the cafeteria configuration, the movable panel 82 may be substantially vertical. As shown in FIG. 3, in the cafeteria configuration, the movable panel 82 may be fully extended (e.g., in a position where the button 102 and the button 302 are engaged with the scoops 104 nearest to a proximal end of the corresponding arms 92). In the cafeteria configuration, a relatively small gap is formed between the bottom edge of the movable panel 82 and the top surface 14 of the countertop 12. As shown, the gap has a distance D.

Figure 4:
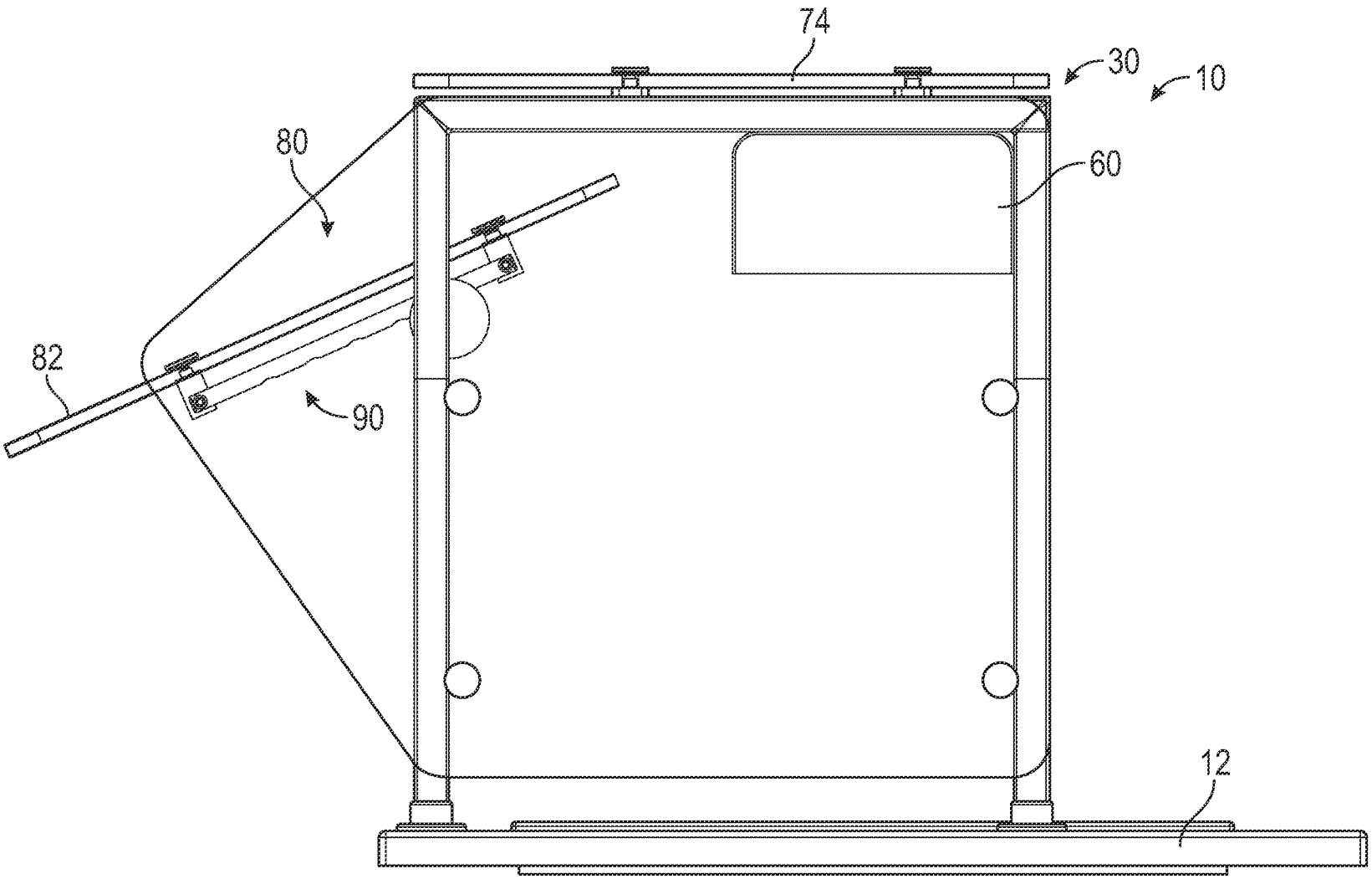
FIG. 4 is a right side view of the breath guard of FIG. 1 with the shield assembly in an intermediate raised configuration, according to an exemplary embodiment.

In FIG. 4, the shield assembly 80 has been reconfigured into an intermediate raised configuration. To reconfigure the shield assembly 80 from the intermediate raised configuration, the user may apply a lifting force to the movable panel 82, raising the shield assembly 80. The user may continue raising the shield assembly 80 until the movable panel 82 is at or slightly above the rotational position corresponding to the buffet configuration. Assuming that the ratcheting hinge 100 is already in the ratcheting configuration, when the user releases the movable panel 82 the ratcheting hinge 100 will retain the movable panel 82 in the discrete rotational position corresponding to the buffet configuration. If the user finds that the shield assembly 80 is still lower than the desired rotational position, the user may repeatedly apply the lifting force until the desired rotational position is achieved.

In FIG. 5, the shield assembly 80 has been reconfigured into a self-serve configuration or buffet configuration. To reconfigure the shield assembly 80 from the intermediate raised configuration to the buffet configuration, the user may depress both the button 102 and the button 302 to permit the movable panel 82 to translate. The user may move the movable panel 82 inward until the desired translational position is reached. As shown in FIG. 5, in the buffet configuration, the movable panel 82 may be fully retracted (e.g., in a position where the button 102 and the button 302 are engaged with the scoops 104 nearest to a distal end of the corresponding arms 92). In the buffet configuration, the bottom or distal edge of the movable panel 82 may be recessed slightly behind a front edge of the side panels 72.

Figure 7:
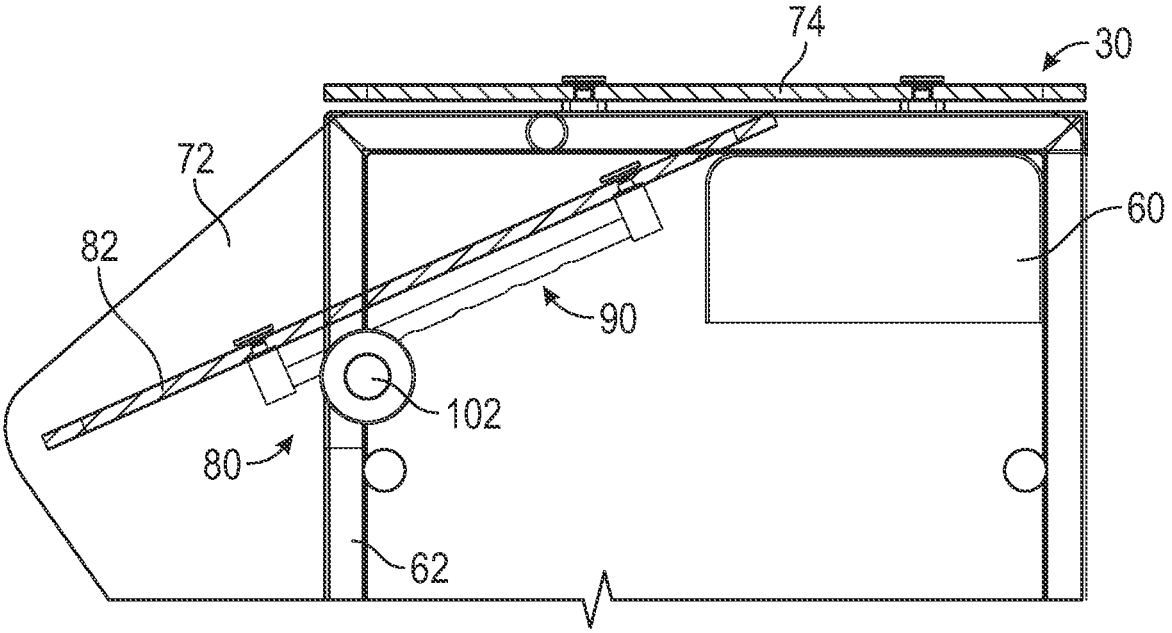
FIG. 7 is a right section view of a portion of the breath guard of FIG. 1 with the shield assembly in the buffet configuration of FIG. 5.

Moving the shield assembly 80 to the intermediate raised configuration prior to entering the buffet configuration may facilitate movement of the shield assembly 80 without the movable panel 82 colliding with other components of the system 10. As shown in FIG. 7, in the buffet configuration, the proximal end of the movable panel 82 is positioned between the accessory 60 and the top panels 74. If the shield assembly 80 were to rotate from this position, the movable panel 82 could collide with the top panels 74 or the accessory 60, limiting movement and potentially causing damage. By orienting the shield assembly 80 before the movable panel 82 translates inward, this potential collision is prevented.

In FIG. 6, the shield assembly 80 has been reconfigured into a release configuration. To reconfigure the shield assembly 80 from the buffet configuration into the release configuration, the user may first reconfigure the shield assembly 80 back into the intermediate raised configuration. Specifically, the user may depress the button 102 and the button 304, freeing the movable panel 82 to translate. The user may extend the movable panel 82 outward until the movable panel 82 reaches the fully extended position.

After reaching the intermediate raised configuration, the user may lift the shield assembly 80 until the shield assembly 80 reaches the release configuration. The release configuration may correspond to the upper limit position of the movable panel 82. In response to the user input forcing the shield assembly 80 into the release configuration, the ratcheting hinge 100 is automatically reconfigured into the disengaged configuration. In the disengaged configuration, the ratcheting hinge 100 permits the movable panel 82 to be lowered until the movable panel 82 reaches the lower limit position. In response to the shield assembly 80 reaching the cafeteria configuration and/or the movable panel 82 moving near the lower limit position, the ratcheting hinge 100 may be automatically reconfigured into the ratcheting configuration, and the cycle shown in FIGS. 3-7 may be repeated.

The breath guard 30 may be conform to various standards for breath guards or food shields. By way of example, the breath guard 30 may be configured to conform to NSF/ANSI 2. Specifically, the cafeteria configuration of the shield assembly 80 may correspond to an NSF cafeteria position conforming to NSF/ANSI 2 (e.g., at least the "food shields for use on cafeteria counters" section of NSF/ANSI 2, etc.), and the buffet configuration of the shield assembly 80 may correspond to at least one NSF buffet positon conforming to NSF/ANSI 2 (e.g., at least the "self-service food shields" section of NSF/ANSI 2, etc.). In accordance with NSF/ANSI 2, a distance between the movable panel 82 and the nearest side panel 72 may be a maximum of 0.75 inches (e.g., in both the NSF cafeteria position and the NSF buffet position). In the NSF cafeteria position, a vertical distance between the movable panel 82 and the top surface 14 (shown as distance D in FIG. 3) may be a maximum of 1.5 inches. In other embodiments, the breath guard 30 functions as a device not specifically intended for use as a food shield or for food service. For example, in these embodiments, the breath guard may be a convertible shield/shelf device in which the device is usable as a shelf with the adjustable panel arranged horizontally and as a shield with the adjustable panel arranged in other positions (e.g., a vertical position).

Ratcheting Hinge-Components

Figure 10:
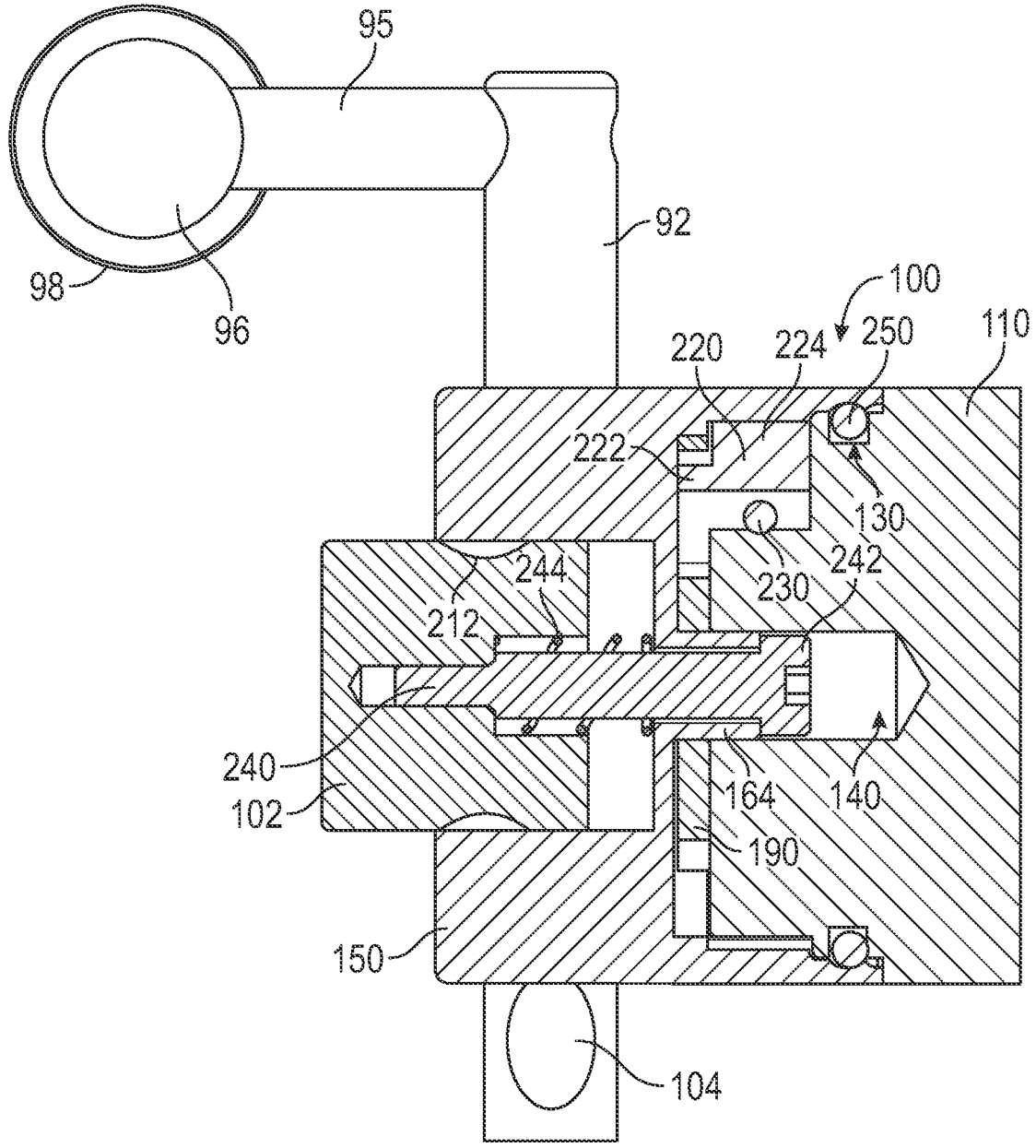
FIG. 10 is a section view of the ratcheting hinge assembly and the positioner assembly of FIG. 9.
Figure 11:
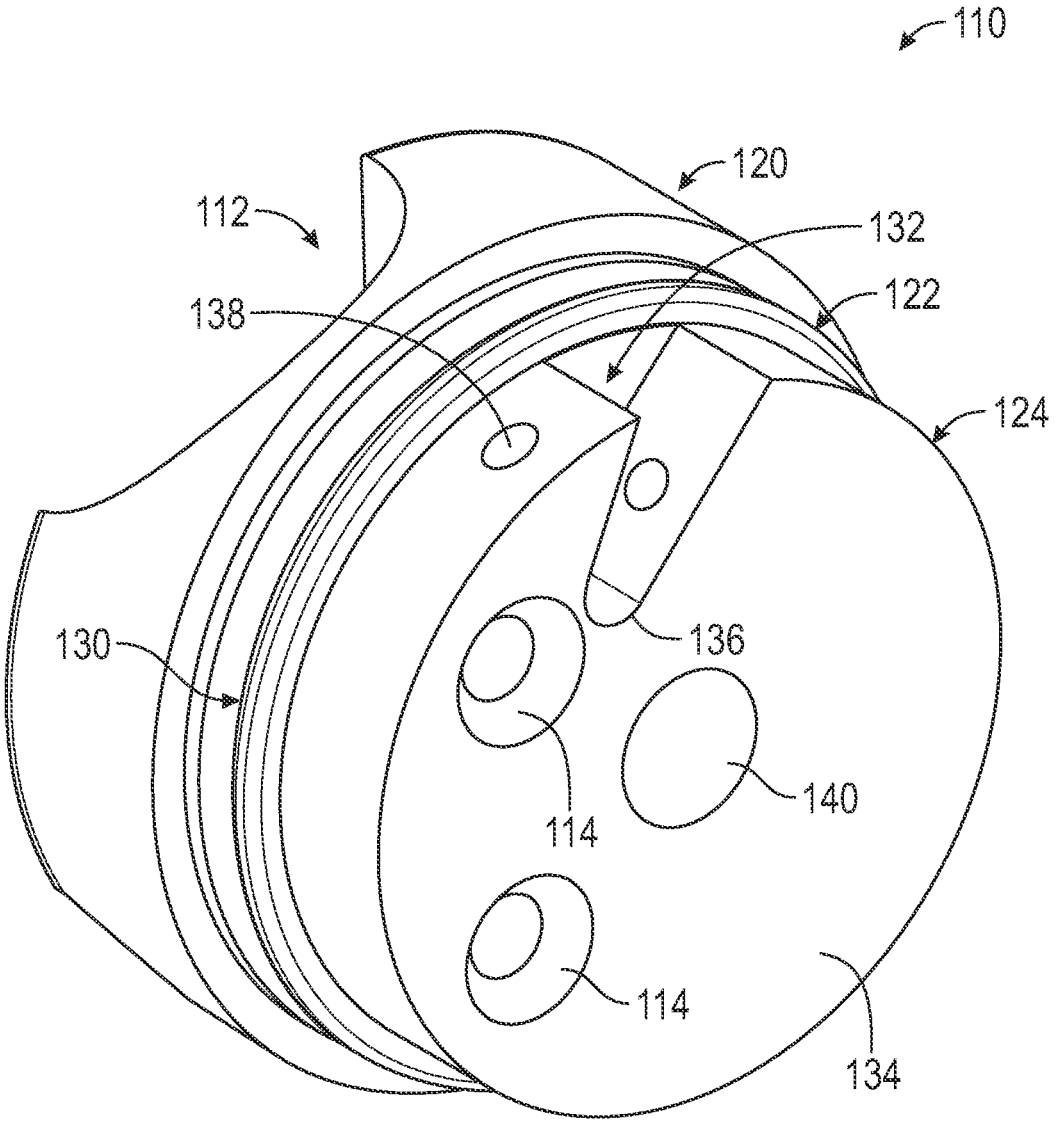
FIG. 11 is a perspective view of a base of the ratcheting hinge assembly of FIG. 9.
Figure 13:
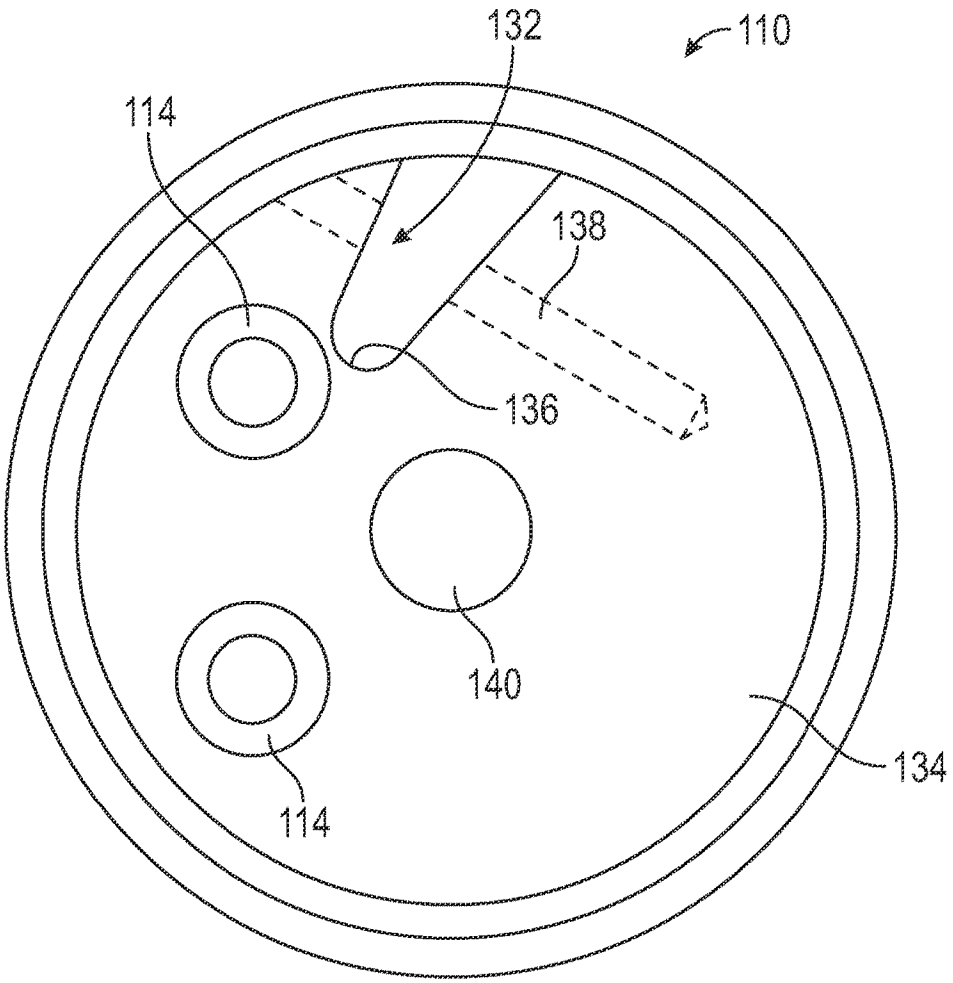
FIG. 13 is a front view of the base of FIG. 11.
Figure 12:
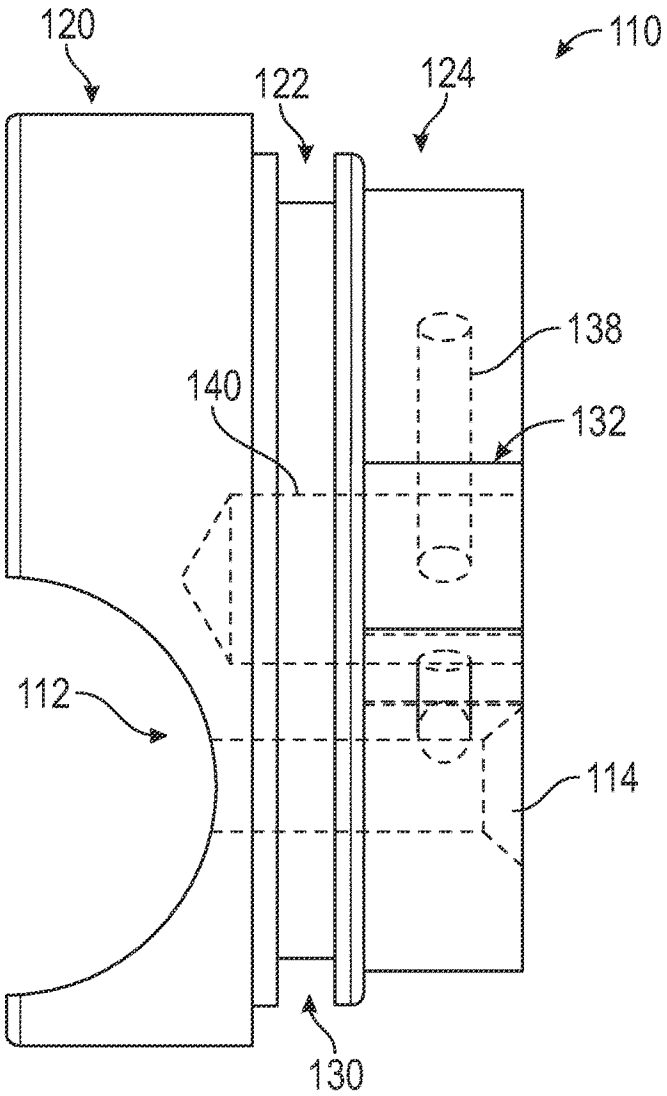
FIG. 12 is a top view of the base of FIG. 11.
Figure 15:
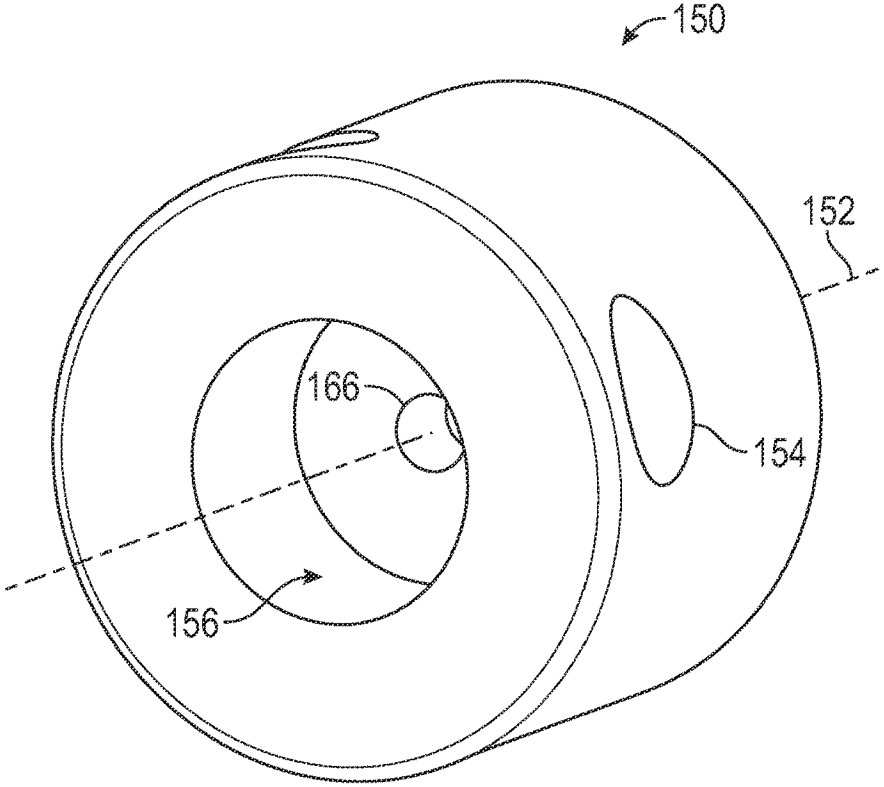
FIGS. 14 and 15 are perspective views of a cap of the ratcheting hinge assembly of FIG. 9.
Figure 14:
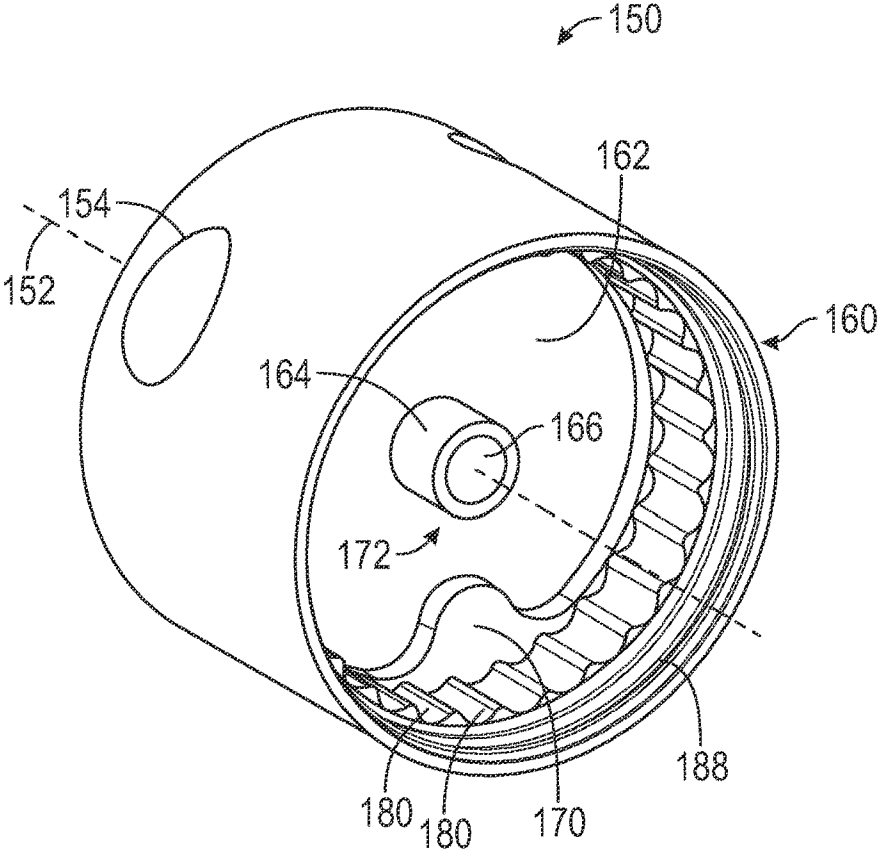
Figure 17:
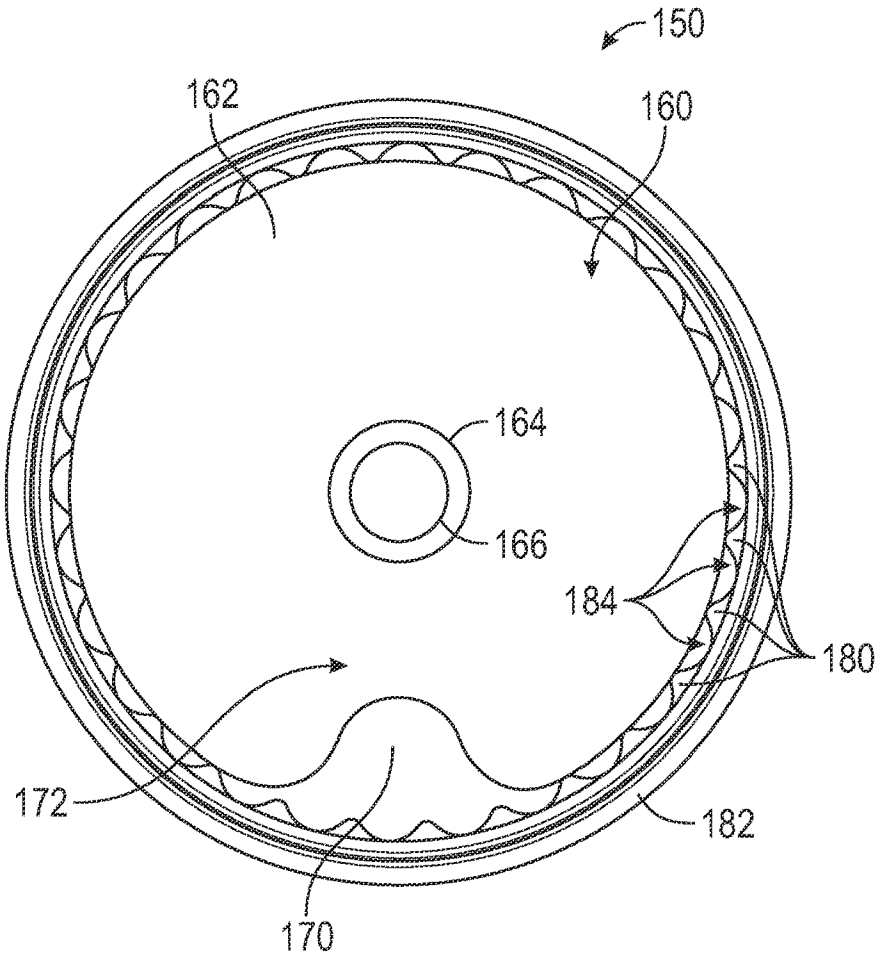
FIG. 17 is a front view of the cap of FIG. 14.
Figure 16:
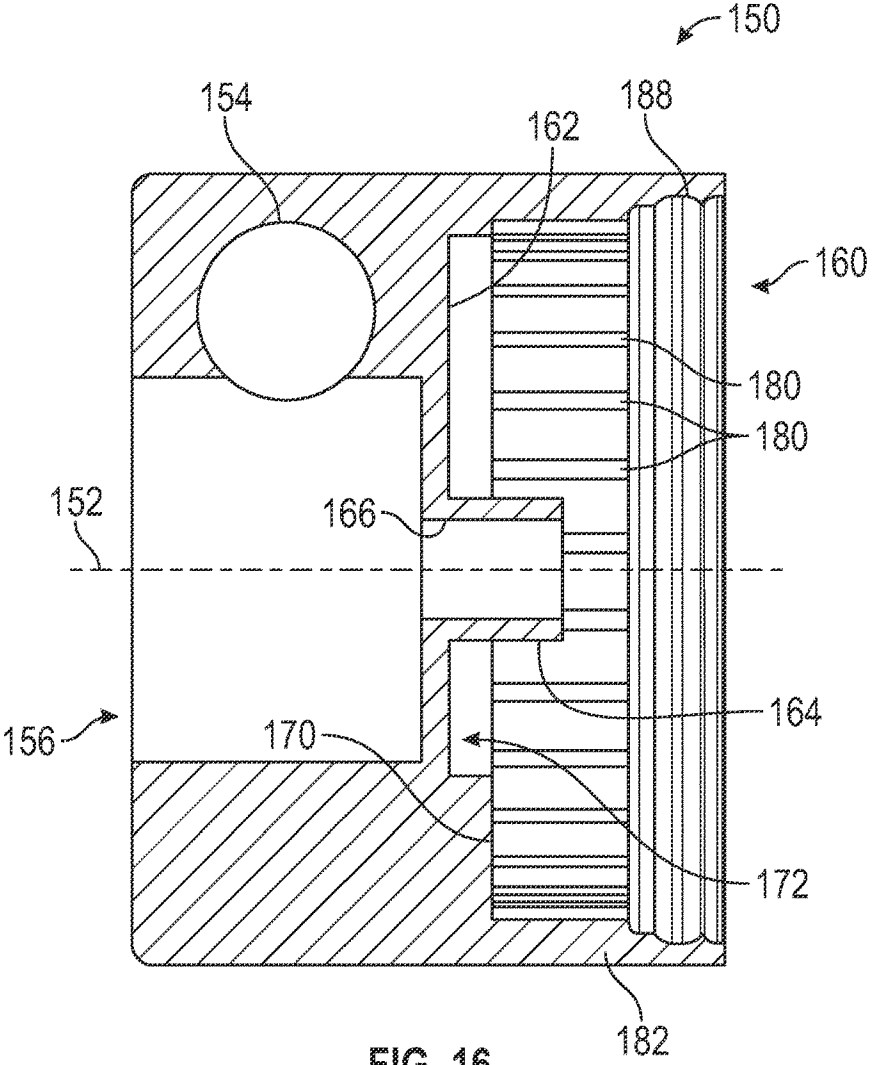
FIG. 16 is a left section view of the cap of FIG. 14.

Referring to FIGS. 9 and 10, the ratcheting hinge 100 is shown according to an exemplary embodiment. The ratcheting hinge 100 includes a base 110 that is coupled to the frame 40 by a pair of screws 116. A cap 150 is selectively slidably coupled to the arm 92 and rotatably coupled to the base 110. A packing 250 forms a seal between the base 110 and the cap 150. The button 102 is slidably coupled to the cap 150 by a shoulder bolt 240 and selectively engages the arm 92 to selectively permit translation of the arm 92 relative to the cap 150. A compression spring 244 biases the button 102 outward from the cap 150. A cog 220 is pivotally coupled to the base 110. The cog 220 engages an inner surface of the cap 150 to limit rotation of the cap 150 relative to the base 110 in a first rotational direction and permit rotation of the cap 150 relative to the base 110 in a second rotational direction. A reset pin 230 and a compression spring 232 are coupled to the base 110 and bias the cog 220 toward the cap 150. A cam plate 190 is pivotally coupled to the cap 150 and selectively retracts the cog 220 to permit movement of the cap 150 relative to the base 110 in both rotational directions.

Referring to FIGS. 9-13, the ratcheting hinge 100 includes a base portion or body, shown as base 110. The base 110 is removably coupled to the vertical member 50. Specifically, the base 110 defines a recess, shown as tube recess 112. The tube recess 112 is sized to receive the vertical member 50. In some embodiments, the vertical member 50 has a substantially circular cross section, and the tube recess 112 has a corresponding semicircular cross section that receives the vertical member 50. The base 110 defines a pair of apertures, shown as screw apertures 114, that extend through the base 110. Each screw aperture 114 is configured to receive a fastener, shown as screw 116. In some embodiments, the screw apertures 114 include a countersink and the screws 116 are countersunk such that the screws 116 sit flush with or below the outer surface of base 110 (e.g., the end face 134). The screw apertures 114 intersect the tube recess 112 such that the screws 116 engage the vertical member 50. In some embodiments, the vertical member 50 defines a pair of threaded holes that receive the screws 116, and the screws 116 removably and fixedly couple the base 110 to the vertical member 50. In some embodiments, the screw apertures 114 and the tube recess 112 are offset relative to the center of the base 110 such that the base 110 is offset relative to the center of the vertical member 50. In other embodiments, the base 110 defines more or fewer (e.g., one, three, etc.) screw apertures 114.

The base 110 includes a series of substantially cylindrical sections that are aligned with one another (e.g., centered about a common axis). The base 110 includes a first, largest section, shown as outer section 120. Coupled to the outer section 120 is a second, mid-sized section, shown as middle section 122. Coupled to the middle section 122 opposite the outer section 120 is an inner section 124. The outer section, the middle section 122, and the inner section may be integrally formed as a single, continuous piece (e.g., machined from a single piece of material). The outer diameter of the outer section 120 is greater than the outer diameter of the middle section 122. The outer diameter of the middle section 122 is greater than the outer diameter of the inner section 124.

The outer section 120 defines the tube recess 112. The middle section 122 defines an annular recess or O-ring groove, shown as seal recess 130. The seal recess 130 surrounds the middle section 122. The inner section 124 defines a recess, shown as cog recess 132. The cog recess 132 extends radially inward from an outer circumference of the inner section 124 and inward from an end surface or end face 134 of the inner section 124. The cross-sectional area of the cog recess 132 is substantially constant as the cog recess 132 extends inward from the end face 134. The cog recess 132 decreases in cross-sectional area as the cog recess 132 extends radially inward from the outer circumference. The innermost portion of the cog recess 132 forms an arcuate surface 136 having a substantially constant radius. A recess or blind hole, shown as pin recess 138, extends partway through the inner section 124. Specifically, the pin recess 138 extends inward from the outer circumference of the inner section 124, crosses the cog recess 132, and ends partway through the inner section 124. The base 110 further defines an aperture, recess, passage, or blind hole, shown as shaft recess 140, that is substantially cylindrical. The shaft recess 140 is substantially aligned with (e.g., centered about) the outer section 120, the middle section 122, and the inner section 124. The shaft recess 140 extends inward from the end face 134, through the inner section 124 and the middle section 122, and partway through the outer section 120.

Referring to FIGS. 9-13, the ratcheting hinge 100 includes a body, cylindrical cap portion, rotating portion, or connecting portion, shown as cap 150, that is rotatably coupled to the base 110. The cap 150 is substantially cylindrical and centered about a central axis 152. The cap 150 defines a first circular aperture or passage (e.g., a shaft passage), shown as arm passage 154, that extends through the cap 150. The arm passage 154 is substantially perpendicular to the central axis 152 and offset from the central axis 152. The arm passage 154 receives the arm 92, slidably coupling the arm 92 to the cap 150. An aperture or recess, shown as button recess 156, extends into the cap 150 from a first end or outer end of the cap 150. The button recess 156 is substantially cylindrical and centered about the central axis 152. The button recess 156 intersects the arm passage 154. The button recess 156 slidably receives the button 102.

Referring to FIGS. 14-17, an aperture or recess, shown as base recess 160, extends into the cap 150 from a second end or inner end of the cap 150, terminating at a divider wall 162. The base recess 160 is substantially centered about the central axis 152. A partition or divider wall 162 separates the base recess 160 from the button recess 156. The divider wall 162 extends substantially perpendicular to the central axis 152. An annular protrusion, shown as shaft 164, extends outward into the base recess from the divider wall 162. The shaft 164 is substantially cylindrical and sized to be received by the shaft recess 140 of the base 110. A passage or aperture, shown as fastener passage 166, extends through the shaft 164, connecting (e.g., fluidly coupling) the base recess 160 and the button recess 156. The fastener passage 166 is substantially centered about the central axis 152.

A protrusion, shown as cam 170, is positioned within the base recess 160 along the divider wall 162. Specifically, the cam 170 extends outward from the divider wall 162, away from the button recess 156. The cam 170 is radially offset from the shaft 164 such that a gap or space 172 is defined between the cam 170 and the shaft 164.

A series of radial protrusions, ratchet protrusions, or teeth, shown as ratchet teeth 180, extend radially inward from an annular wall, shown as outer wall 182, of the cap 150 that surrounds the base recess 160. The outer wall 182 is annular such that each of the ratchet teeth 180 are positioned at a substantially identical distance from the central axis 152. Each adjacent pair of ratchet teeth 180 defines a pawl recess or scoop, shown as cog recess 184, that extends radially outward from the base recess 160. Each cog recess 184 is curved. By way of example, the cog recesses 184 may each have a semicircular cross section. The ratchet teeth 180 are substantially identical in size and shape and positioned at regular intervals along the inner surface of the outer wall 182. Accordingly, the cog recesses 184 are each substantially identical to one another in size and shape. The cog recesses 184 are each angularly offset from one another about the central axis 52. As shown, the spacing between the ratchet teeth 180 is set such that an integer number of ratchet teeth 180 cover the entire inner surface of the outer wall 182. In other embodiments, the cap 150 defines more or fewer ratchet teeth 180. By way of example, the cap 150 may define ratchet teeth 180 over only a portion of the inner surface of the outer wall 182.

The outer wall 182 further defines an annular recess or O-ring groove, shown as seal recess 188. The seal recess 188 is centered about the central axis 152. The seal recess 188 is positioned along an inner surface of the outer wall 182 and surrounds the base recess 160. In some embodiments, the seal recess 188 has a curved (e.g., semicircular) cross section.

The divider wall 162, the cam 170, the ratchet teeth 180, and the seal recess 188 are each located at different longitudinal positions along the central axis 152. The divider wall 162 defines the innermost portion of the base recess 160. The cam 170 is positioned outward of the divider wall 162. The ratchet teeth 180 are positioned outward of the cam 170 such that the cam 170 is positioned between the divider wall 162 and the ratchet teeth 180. The seal recess 188 is positioned outward of the ratchet teeth 180 such that the ratchet teeth 180 are positioned between the cam 170 and the seal recess 188.

Figure 18:
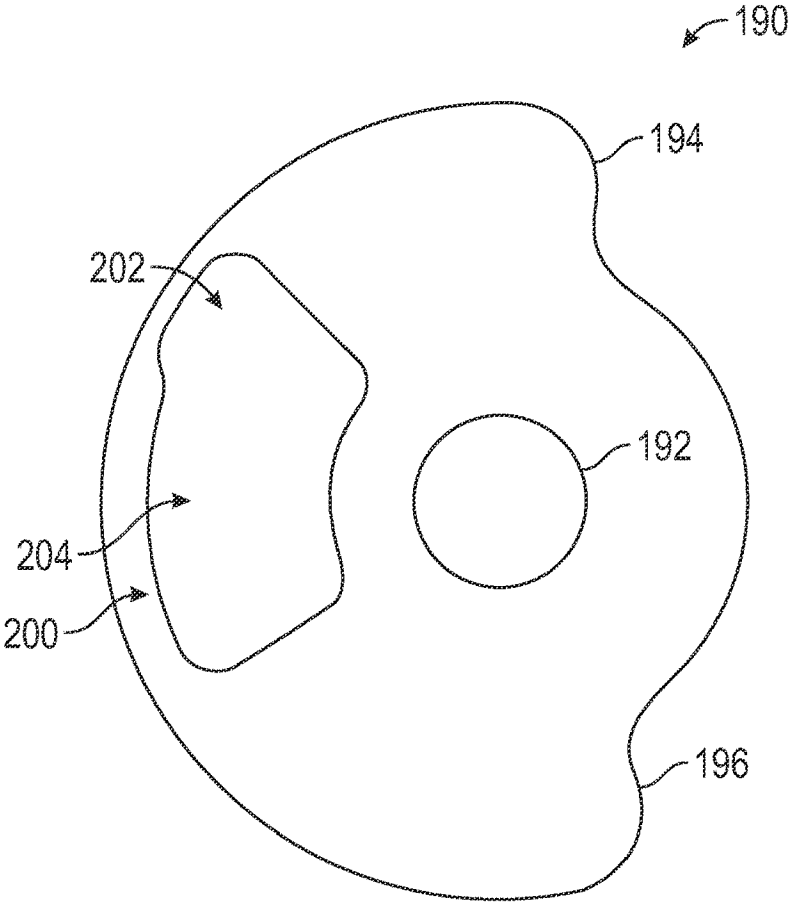
FIG. 18 is a front view of a cam plate of the ratcheting hinge assembly of FIG. 9.

Referring to FIGS. 9, 10, and 18, the ratcheting hinge 100 further includes a rotating portion, cam portion, reset portion, pawl retracting portion, or plate, shown as cam plate 190. The cam plate 190 may have a substantially uniform thickness (e.g., may be substantially flat). By way of example, the cam plate 190 may be cut from a sheet or plate of material. The cam plate 190 defines a circular aperture or passage, shown as shaft aperture 192. The shaft aperture 192 is sized to receive the shaft 164 of the cap 150 to pivotally couple the cam plate 190 to the cap 150. The cam plate 190 further defines a set of protrusions, cams, contact surfaces, portions, or stops, shown as engaging stop 194 and disengaging stop 196. The engaging stop 194 and the disengaging stop 196 are each radially offset from the shaft aperture 192 such that each of the engaging stop 194 and the disengaging stop 196 are positioned at substantially the same distance from the center of the shaft aperture 192. The engaging stop 194 and the disengaging stop 196 face one another (e.g., are oriented to face opposing directions).

The cam plate 190 further defines a passage or aperture, shown as pawl slot 200. The pawl slot 200 is radially offset from the shaft aperture 192. The pawl slot 200 is curved and has a radius of curvature that is approximately centered about the shaft aperture 192. The pawl slot 200 includes a first portion or engaging portion, shown as wide portion 202, and a second portion or disengaging portion, shown as narrow portion 204. The wide portion 202 is wider (e.g., a greater radial dimension) than the narrow portion 204.

Figure 19:
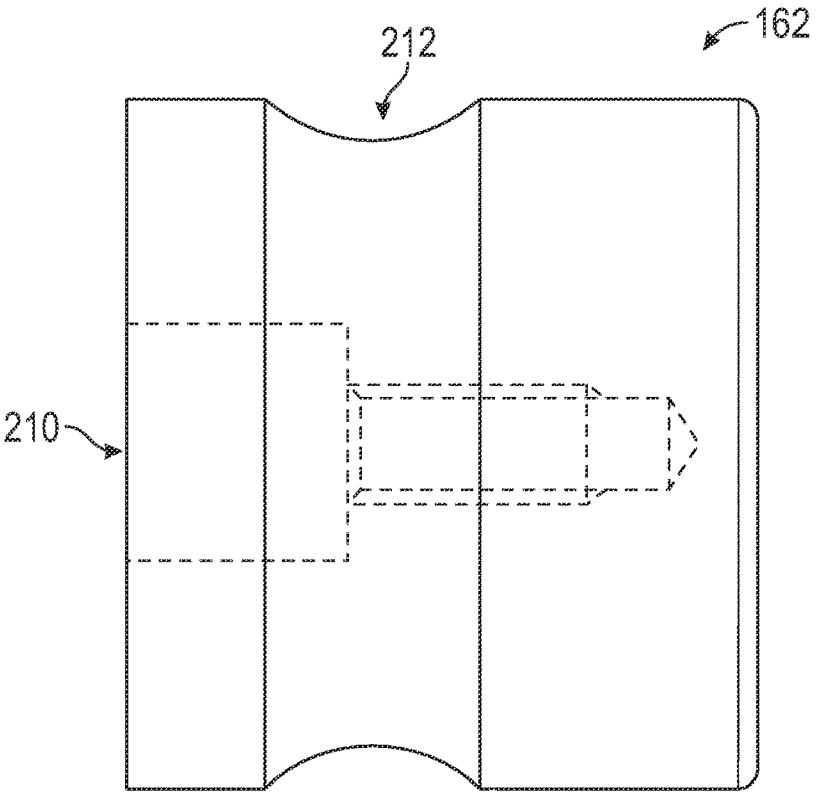
FIG. 19 is a front view of a button of the ratcheting hinge assembly of FIG. 9.

Referring to FIGS. 9, 10, and 19, the button 102 is shown according to an exemplary embodiment. The button 102 and the button 302 may be substantially similar, except as otherwise stated herein. The button 102 is substantially cylindrical. The button 102 defines an aperture, recess, or blind hole, shown as threaded recess 210, that is substantially centered along the button 102. The threaded recess 210 is configured to threadably engage a fastener (e.g., the shoulder bolt 240). The button 102 further defines a circumferential or annular groove, slot, or recess, shown as arm slot 212. The arm slot 212 extends along the entire circumference of (e.g., surrounds) the button 102. The arm slot 212 may have a radius of curvature that is similar to the radius of the arm 92.

Referring to FIGS. 9, 10, and 20-23, the ratcheting hinge 100 further includes a pawl, shown as cog 220. The cog 220 includes a first section or shortened section, shown as activator section 222, and a second section or elongated section, shown as pawl section 224. The pawl section 224 is longer than the activator section 222, such that a step is formed on a first end portion of the cog 220 between the activator section 222 and the pawl section 224. A second end portion of the cog 220, shown as curved end 226, is curved to match the arcuate surface 136 of the cog recess 132. The curved end 226 does not include a step between the activator section 222 and the pawl section 224. Accordingly, the curved end 226 can slidably engage the arcuate surface 136 to facilitate pivoting of the cog 220 relative to the base 110.

Referring to FIGS. 9, 10, 21, and 23, the ratcheting hinge 100 further includes a sliding pin, shown as reset pin 230. The reset pin 230 is elongate and includes a first end or engagement end that is curved (e.g., hemispherical). The reset pin 230 is contained within the pin recess 138. Positioned between the reset pin 230 and the enclosed end of the pin recess 138 is a biasing element, shown as compression spring 232. The compression spring 232 is positioned to impart a biasing force onto the reset pin 230, biasing the reset pin 230 toward the open or unenclosed end of the pin recess 138.

Referring to FIGS. 9, 10, and 19, the ratcheting hinge 100 further includes a fastener, shown as shoulder bolt 240. The shoulder bolt 240 includes a threaded portion that is configured to threadably engage the threaded recess 210 of the button 102, coupling the button 102 to the shoulder bolt 240. Opposite the threaded portion is a shoulder or protrusion, shown as head 242. The head 242 is larger than the main shaft of the shoulder bolt 240. In some embodiments, the head 242 includes an interface (e.g., a recess sized to receive a hex key) that facilitates applying a torque to the shoulder bolt 240 during installation.

Ratcheting Hinge—Assembly

Referring to FIGS. 9-23, a method of assembling the ratcheting hinge 100 is described. The steps of the assembly method described herein are exemplary only and may be performed in any order. By way of example, the arm 92 may be assembled with the cap 150 before or after the cap 150 is coupled to the base 110.

The shoulder bolt 240 is inserted through the fastener passage 166 of the cap 150 until the head 242 engages the shaft 164 of the cap 150. The shoulder bolt 240 is further inserted through a biasing element, shown as compression spring 244. The shoulder bolt 240 is then engaged with the threaded recess 210 of the button 102 and tightened to removably and fixedly couple the button 102 with the shoulder bolt 240. Accordingly, the shoulder bolt 240 rotatably and slidably couples the button 102 to the cap 150. In this arrangement, the button 102 is positioned within the button recess 156, and the compression spring 244 is positioned between the divider wall 162 of the cap 150 and the button 102 such that the compression spring 244 applies a biasing force that biases the button 102 outward, away from the divider wall 162. The head 242 of the shoulder bolt 240 limits the outward movement of the button 102. When a user presses the button 102, the biasing force of the compression spring 244 is overcome, and the button 102 moves deeper into the button recess 156.

With the button 102 depressed (e.g., fully depressed such that the button 102 engages the divider wall 162), the arm passage 154 of the cap 150 moves into lateral alignment with the arm slot 212, forming an unobstructed, cylindrical passage through the entire width of the ratcheting hinge 100. In this configuration, the arm 92 may be slid through the arm passage 154 without the button 102 obstructing movement of the arm 92. The arm 92 may be rotated and/or translated until one of the scoops 104 of the arm 92 aligns with the button 102. The button 102 may be released, permitting the compression spring 244 to force the button 102 outward and moving the arm slot 212 out of alignment with the arm passage 154. In this configuration, the button 102 is received within the scoop 104, and the button 102 engages the arm 92 to limit (e.g., prevent) translation and/or rotation of the arm 92 relative to the cap 150.

With the arm 92 extending through the cap 150, the standoff arms 95 may be threaded into the corresponding recesses of the arm 92, coupling the standoff arms 95 to the arm 92. Each standoff arm 95 may be coupled to a corresponding standoff base 96 (e.g., by a setscrew). Each standoff cap 98 may be inserted through an aperture of the movable panel 82 and engaged with the corresponding standoff base 96, coupling the movable panel 82 to the arm 92.

The screws 116 may be inserted through the screw apertures 114 of the base 110 and moved into threaded engagement with the vertical member 50 of the frame 40, removably coupling the base 110 to the frame 40. The screws 116 and the screw apertures 114 may have corresponding countersunk profiles such that the screws 116 sit flush with or below the end face 134 of the base 110. An annular seal or O-ring, shown as packing 250, may be stretched around the base 110 and inserted into the seal recess 130.

The compression spring 232 may be inserted into the pin recess 138, followed by the reset pin 230. The reset pin 230 may be depressed until the reset pin 230 no longer extends into the cog recess 132. The cog 220 may then be inserted into the cog recess 132 such that the activator section 222 of the cog 220 faces away from the outer section 120 of the base 110 (e.g., a distance between the activator section 222 and the outer section 120 is greater than a distance between the pawl section 224 and the outer section 120). The activator section 222 may extend beyond the end face 134 of the base 110. The curved end 226 may engage the arcuate surface 136 of the base 110. In this configuration, the cog 220 may rotate about an axis that extends across the curved end 226 between a disengaged position (shown in FIGS. 20 and 21) and a ratcheting position (shown in FIGS. 22 and 23). The reset pin 230 engages the cog 220 and biases the cog 220 toward the ratcheting position.

Figure 20:
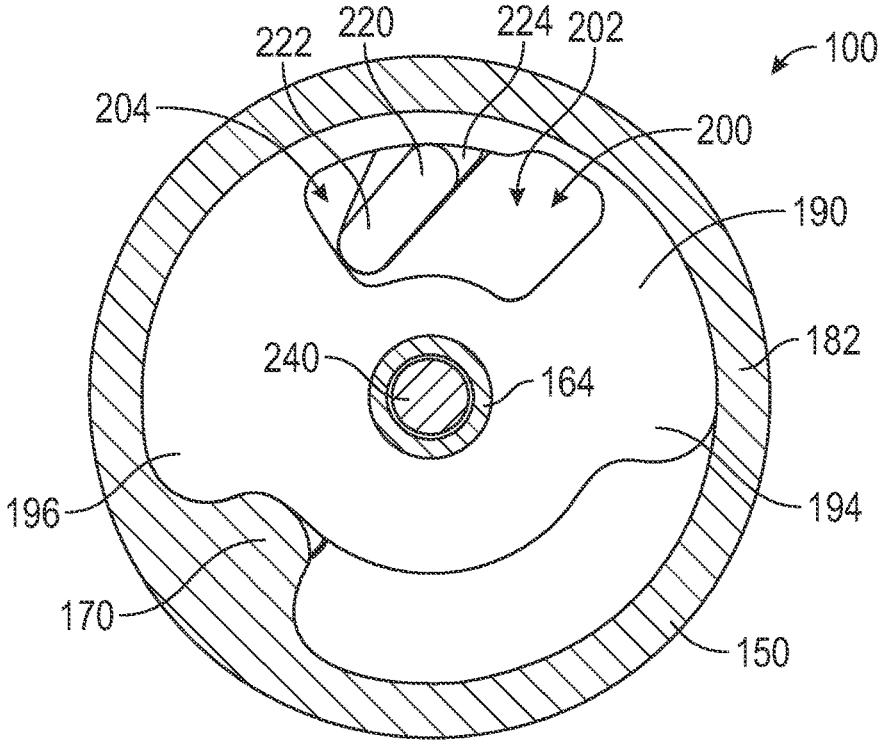
FIGS. 20 and 21 are section views of the ratcheting hinge assembly of FIG. 9 in a disengaged configuration.
Figure 22:
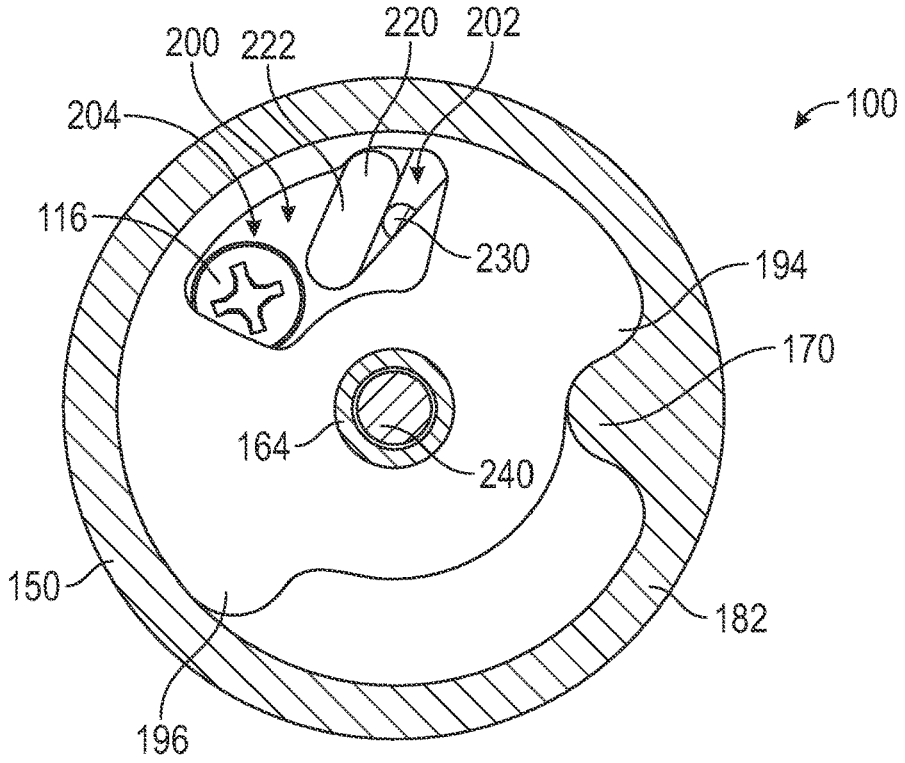
FIGS. 22 and 23 are section views of the ratcheting hinge assembly of FIG. 9 in a ratcheting configuration.

The cam plate 190 is arranged such that the shaft aperture 192 of the cam plate 190 aligns with the shaft 164 of the cap 150. The cam plate 190 is then pressed toward the divider wall 162 of the cap 150 until the cam plate 190 is received in the space 172 between the cam 170 and the shaft 164 (e.g., such that the cam plate 190 engages the divider wall 162). The cam plate 190 is oriented such that the cam 170 is received between the engaging stop 194 and the disengaging stop 196. The cam plate 190 may rotate freely relative to the cap 150 until the cam 170 engages either the engaging stop 194 (e.g., as shown in FIG. 22) or the disengaging stop 196 (e.g., as shown in FIG. 20). Accordingly, the cam 170, the engaging stop 194, and the disengaging stop 196 limit rotation of the cam plate 190 relative to the cap 150.

The cap 150 may then be aligned with the base 110 such that the shaft 164 of the cap 150 and the shoulder bolt 240 are aligned with the shaft recess 140. The cap 150 may then be moved toward the base 110. As the cap 150 moves toward the base 110, the shaft 164 and the head 242 of the shoulder bolt 240 are received within the shaft recess 140. The activator section 222 of the cog 220 enters the pawl slot 200 (e.g., as shown in FIG. 20 or 22). The seal recess 188 of the cap 150 aligns with the seal recess 130 of the base 110, and the packing 250 is received within the seal recess 188. Accordingly, the packing 250 forms a seal between the cap 150 and the base 110 to prevent dirt, water, or other debris from entering the ratcheting hinge 100. The outer wall 182 of the cap 150 engages the middle section 122 of the base 110, acting as a bearing to rotatably couple the cap 150 to the base 110.

Ratcheting Hinge—Operation

Figure 23:
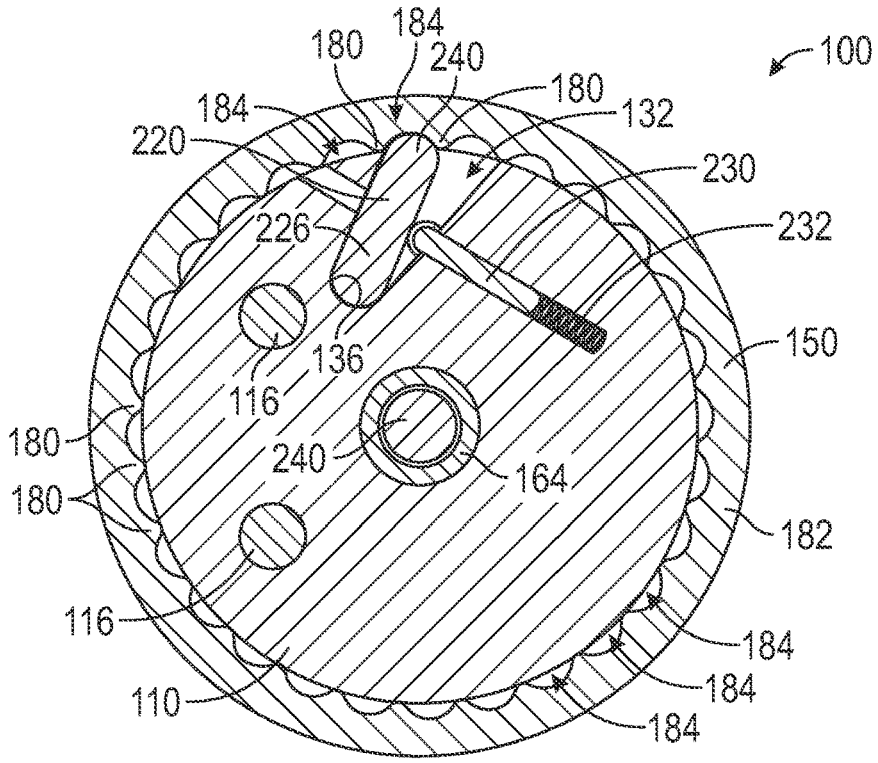

Referring to FIGS. 3-7 and 20-23, the operation of ratcheting hinge 100 is described, according to an exemplary embodiment. FIG. 3 illustrates the shield assembly 80 in the cafeteria configuration, and FIGS. 22 and 23 illustrate the ratcheting hinge 100 in the ratcheting configuration. When the shield assembly 80 is lowered to the cafeteria configuration, the ratcheting hinge 100 is reconfigured into the ratcheting configuration. Specifically, as shown in FIG. 22, the cam 170 engages the engaging stop 194, forcing the cam plate 190 to rotate counterclockwise. This movement of the cam plate 190 aligns the activator section 222 of the cog 220 with the wide portion 202 of the pawl slot 200. The wide portion 202 provides clearance between the cam plate 190 and the activator section 222, permitting the cog 220 to pivot throughout a range of motion that extends between an extended position (shown in FIG. 23) and a retracted position (shown in FIG. 21). The motion of the cog 220 is limited when cog 220 engages one of the walls of the cog recess 132.

The reset pin 230 biases the cog 220 toward the extended position. In the extended position, the pawl section 224 of the cog 220 extends outside of the cog recess 132 of the base 110 to be received within one of the cog recesses 184 and engage one of the ratchet teeth 180. When a downward force (e.g., a gravitational force) is applied to the shield assembly 80, the force imparts a movement effect (e.g., a resultant torque) on the cap 150 in a first rotational direction (i.e., counterclockwise as shown in FIG. 23). This torque causes the ratchet tooth 180 that engages the cog 220 to force the cog 220 in a first translational direction (i.e., leftward as shown in FIG. 23). However, with the cog 220 in the extended position, the cog 220 engages the wall of the cog recess 132, preventing the cog 220 to move further in the first translational direction and preventing movement of the cap 150 in the first rotational direction. Accordingly, with the cog 220 in the extended position, downward movement of the shield assembly 80 is limited (e.g., prevented).

If a user applies an upward force on the shield assembly 80, the force imparts a movement effect (e.g., a resultant torque) on the cap 150 in a second rotational direction (i.e., a clockwise as shown in FIG. 23) that is opposite the first rotational direction. This torque causes one of the ratchet teeth 180 to engage the cog 220, forcing the cog 220 in a second translational direction (i.e., rightward as shown in FIG. 23) that is opposite the first translational direction. This force overcomes the biasing force applied by the reset pin 230 and the compression spring 232, moving the cog 220 toward the retracted position. Once in the retracted position, the ratchet tooth 180 is free to move past the cog 220, and the shield assembly 80 is permitted to move upward. After the ratchet tooth 180 moves past the cog 220, the reset pin 230 returns the cog 220 to the extended position, and the pawl section 224 of the cog 220 enters into the next cog recess 184. This process may be repeated until the shield assembly 80 reaches the release configuration.

If the user releases the shield assembly 80 while the ratcheting hinge 100 is in the ratcheting configuration, the force of gravity will again cause the cog 220 to engage one of the ratchet teeth 180, limiting downward movement of the shield assembly 80. Accordingly, the ratcheting hinge 100 is configured to retain the shield assembly 80 in series of discrete positions. Each discrete position corresponds to (a) one of cog recesses 184 that is occupied by the cog 220 when the shield assembly 80 is in that position and (b) one of the ratchet teeth 180 that the cog 220 engages to limit downward movement of the shield assembly 80 beyond that position. The spacing between the ratchet teeth 180 may be varied to control the granularity of the adjustment that is provided by the ratcheting hinge 100. By way of example, the cap 150 may have as few as one ratchet tooth 180 that corresponds to the buffet configuration of the shield assembly 80. By way of another example, the cap 150 may omit the ratchet teeth 180 and the cog recesses 184 that correspond to positions outside of the range of motion of the shield assembly 80.

The cam plate 190 may remain in the position shown in FIG. 22 as the shield assembly 80 is raised. As the shield assembly 80 is raised, the cam 170 may disengage from the engaging stop 194 and move toward the disengaging stop 196. As the shield assembly 80 approaches the release configuration, the cam 170 may engage the disengaging stop 196. If upward movement of the shield assembly 80 continues, the cam 170 forces the cam plate 190 into the position shown in FIG. 20, and the ratcheting hinge 100 is reconfigured into the disengaged configuration.

Figure 21:
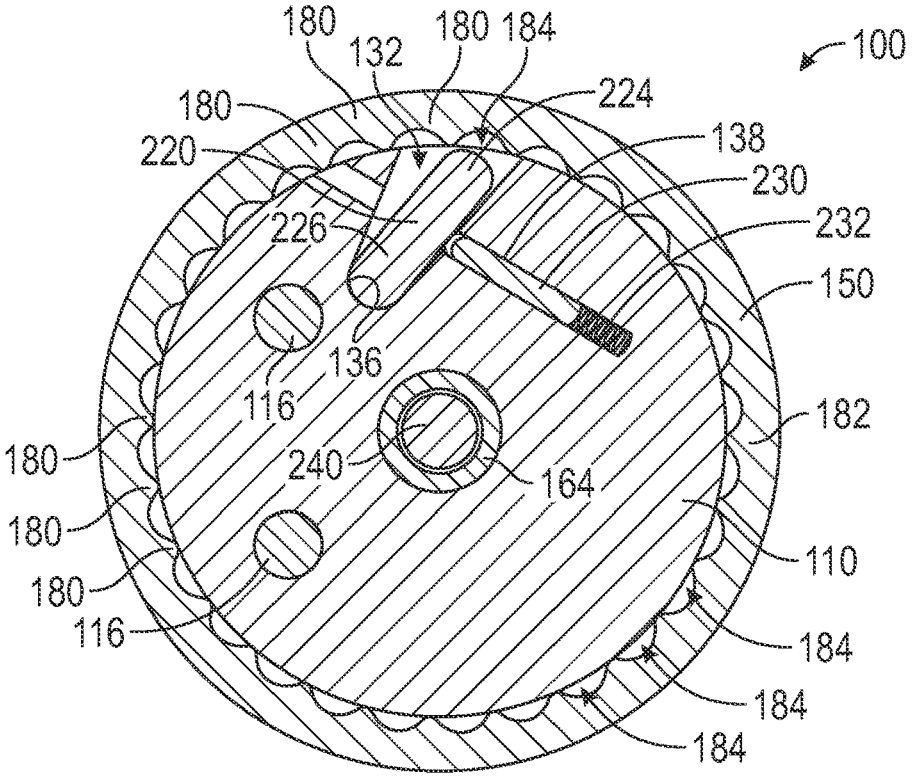

FIG. 6 illustrates the shield assembly 80 in the release configuration, and FIGS. 20 and 21 illustrate the ratcheting hinge 100 in the disengaged configuration. When the shield assembly 80 is raised to the release configuration, the ratcheting hinge 100 is automatically reconfigured into the disengaged configuration (e.g., due to rotation of the cam plate 190). As shown in FIG. 20, when the ratcheting hinge 100 is in the disengaged configuration, the activator section 222 of the cog 220 is aligned with the narrow portion 204 of the pawl slot 200 of the cam plate 190. The narrow portion 204 is narrower than the wide portion 202 such that the cam plate 190 forces the cog 220 toward the retracted position. The cam plate 190 overcomes the biasing force of the reset pin 230, holding the cog 220 in the retracted position as long as the ratcheting hinge is in the disengaged configuration. With the cog 220 held in the retracted position by the cam plate 190, clearance is provided between the cog 220 and the ratchet teeth 180, permitting free downward movement of the shield assembly 80.

When the shield assembly 80 is lowered while the ratcheting hinge 100 is in the disengaged configuration, the cam 170 begins moving toward the engaging stop 194 of the cam plate 190. As the shield assembly 80 approaches the cafeteria configuration, the cam 170 may engage the engaging stop 194. If downward movement of the shield assembly 80 continues, the cam 170 forces the cam plate 190 into the position shown in FIG. 22, and the ratcheting hinge 100 is reconfigured into the ratcheting configuration.

In some embodiments, the cam 170, the cam plate 190, the cog 220, and the base 110 cooperate to provide a hard stop that limits upward movement of the shield assembly 80 beyond a predetermined upper limit position (e.g., corresponding to the release configuration). The cam plate 190 may be sized such that the cam plate 190 engages the activator section 222 of the cog 220 to limit movement of the cog 220 deeper into the narrow portion 204 (e.g., as shown in FIG. 20). In such a configuration, a series of components may engage one another to limit upward movement of the shield assembly 80. Specifically, the hard stop may be achieved due to (a) contact between the cam 170 and the disengaging stop 196 of the cam plate 190 that limits movement of the cap 150 relative to the cam plate 190, (b) contact between the cam plate 190 and the activator section 222 that limits movement of the cam plate 190 relative to the cog 220, and (c) contact between the cog 220 and a wall of the cog recess 132 that limits movement of the cog 220 relative to the base 110.

In some embodiments, the cam 170, the cam plate 190, the cog 220, and the base 110 cooperate to provide a hard stop that limits downward movement of the shield assembly 80 beyond a predetermined lower limit position (e.g., corresponding to the cafeteria configuration). The cam plate 190 may be sized such that the cam plate 190 engages the activator section 222 of the cog 220 to limit movement of the cog 220 deeper into the wide portion 202. In such a configuration, a series of components may engage one another to limit downward movement of the shield assembly 80. Specifically, the hard stop may be achieved due to (a) contact between the cam 170 and the engaging stop 194 of the cam plate 190 that limits movement of the cap 150 relative to the cam plate 190, (b) contact between the cam plate 190 and the activator section 222 that limits movement of the cam plate 190 relative to the cog 220, and (c) contact between the cog 220 and a wall of the cog recess 132 that limits movement of the cog 220 relative to the base 110.

FIG. 10 illustrates the operation of the ratcheting hinge 100 that permits adjustment of the translational position of the movable shield 82. A similar procedure may be followed using the button 302 of the free hinge 300. The button 102 is repositionable between an extended position or engaged position (shown in FIG. 10) and a retracted position or disengaged position. In the retracted position, the button 102 is offset inward toward the divider wall 162 (e.g., in contact with the divider wall 162). To move the button from the extended position to the retracted position, a user may apply an inward force on the button 102. To move the button 102 form the retracted position to the extended position, the user may release the button 102 to permit the compression spring 244 to force the button 102 outward.

In the extended position, shown in FIG. 10, the arm slot 212 of the button 102 is offset from the arm passage 154 such that the button 102 is received within one of the scoops 104 of the arm 92. The button 102 engages the wall of the scoop 104, which limits (e.g., prevents) movement of the arm 92 along the arm passage 154. The translational position of the arm 92 (and thus the translational position of the movable shield 82) corresponds to which of the scoops 104 is engaged by the button 102. In the retracted position, the button 102 is moved inward such that the arm slot 212 is aligned with the arm passage 154 (e.g., the arm slot 212 and the arm passage 154 are centered about a common vertical plane). With the arm slot 212 aligned with the arm passage 154, the arm slot 212 provides clearance around the arm 92, permitting the arm 92 to move freely along the arm passage 154. When the user has moved the arm 92 to the desired translational position, the button 102 may be released to once again hold the arm 92 in place.

Free Hinge

Referring to FIGS. 24-29, the free hinge 300 is shown according to an exemplary embodiment. The free hinge 300 may be substantially similar to the ratcheting hinge 100 except as otherwise specified herein. The free hinge 300 includes a base 310 that is coupled to the frame 40 by a pair of screws 116. A cap 350 is selectively slidably coupled to the arm 92 and rotatably coupled to the base 310. A packing 250 forms a seal between the base 310 and the cap 350. The button 302 is slidably coupled to the cap 350 by a shoulder bolt 240 and selectively engages the arm 92 to selectively permit translation of the arm 92 relative to the cap 350. A compression spring 244 biases the button 102 outward from the cap 150. The free hinge 300 omits components used by the ratcheting hinge 100 to limit rotation, such as the cog 220, the reset pin 230, the compression spring 232, and the cam plate 190. The free hinge 300 further includes a bolt assembly 320 that is received within the base 310 and configured to engage the cap 350 to limit (e.g., inhibit, prevent, etc.) rotation of the cap 350 relative to the base 310.

Referring to FIGS. 24-27, the ratcheting hinge 100 includes a base portion or body, shown as base 310. The base 310 may be substantially similar to the base 110 except as otherwise specified herein. The base 110 is removably coupled to one of the vertical members 42 of the frame 40. Specifically, the base 110 defines a tube recess 112 that is sized to receive the vertical member 42. The base 110 defines a pair of screw apertures 114 that are configured to receive a screw 116. In some embodiments, the vertical member 42 defines a pair of threaded holes that receive the screws 116, and the screws 116 removably and fixedly couple the base 110 to the vertical member 42. In some embodiments, the screw apertures 114 and the tube recess 112 are offset relative to the center of the base 310 such that the base 310 is offset relative to the center of the vertical member 42. The base 310 omits the cog recess 132 and the pin recess 138 of the base 110.

Adjacent the shaft recess 140, the base 110 further defines an aperture, recess, passage, or blind hole, shown as bolt recess 312 that is substantially cylindrical. The bolt recess 312 is substantially parallel to the shaft recess 140 and radially offset from the shaft recess 140. The bolt recess 312 extends inward from the end face 134, through the inner section 124 and the middle section 122, and partway through the outer section 120. A slot or groove, shown as pin slot 314, extends between the bolt recess 312 and the shaft recess 140, such that the bolt recess 312, the shaft recess 140, and the pin slot 314 are fluidly coupled to one another and form a continuous space.

Referring to FIGS. 24, 25, 28, and 29, the free hinge 300 includes a cylindrical cap portion, rotating portion, or connecting portion, shown as cap 350, that is rotatably coupled to the base 310. The cap 350 may be substantially similar to the cap 350, except as otherwise specified herein. The cap 350 omits the cam 170, the ratchet teeth 180, and the cog recesses 184 of the cap 150. The cap 350 further defines an aperture or passage, shown as bolt passage 360. The bolt passage 360 extends through the divider wall 162. The bolt passage 360 is substantially parallel to the fastener passage 166 and radially offset from the fastener passage 166. In some embodiments, the center-to-center distance between the bolt passage 360 and the fastener passage 166 is substantially equal to the center-to-center distance between the shaft recess 140 and the bolt recess 312.

Figure 24:
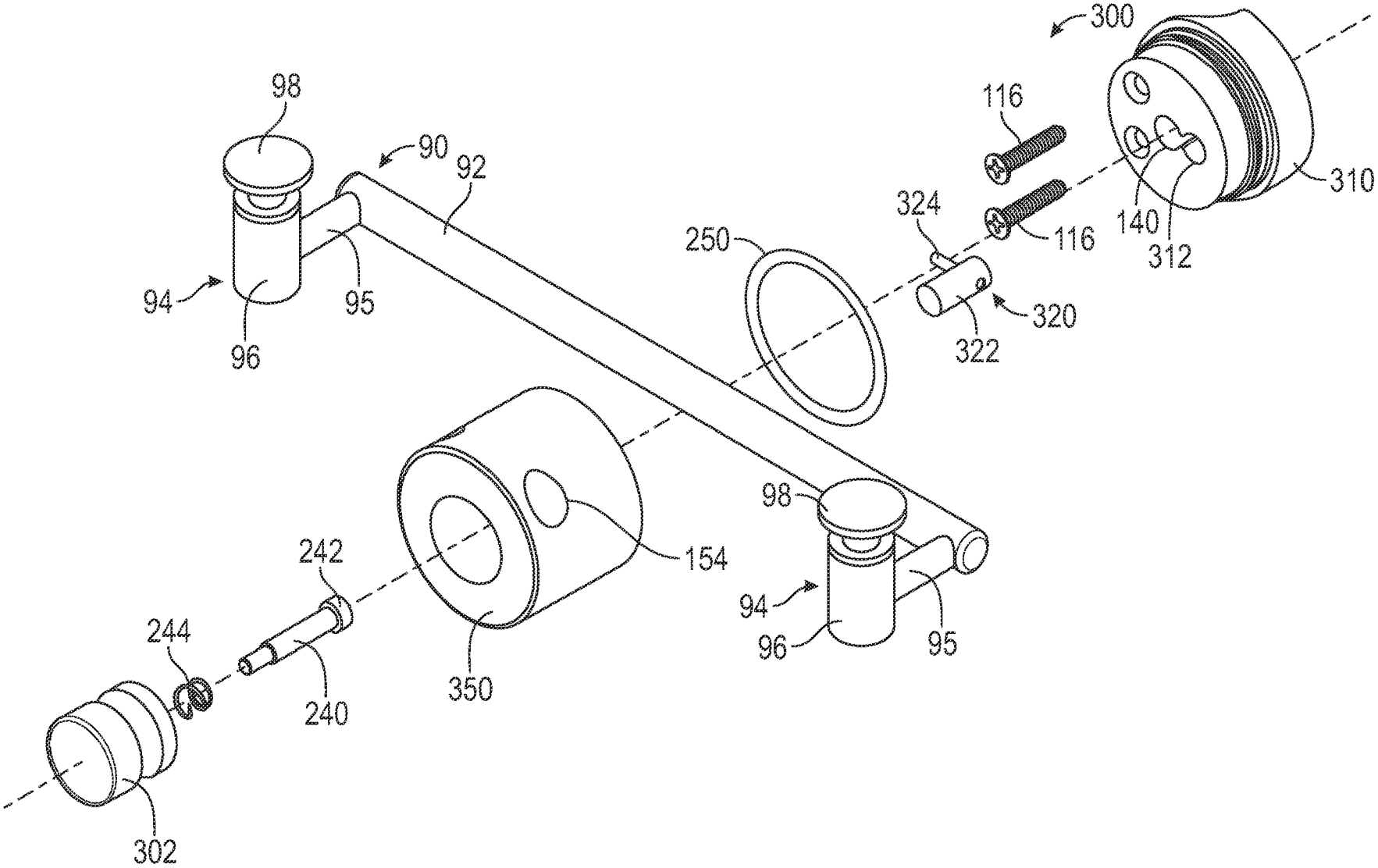
FIG. 24 is an exploded view of a free hinge assembly and a positioner assembly of the shield assembly of FIG. 1.
Figure 25:
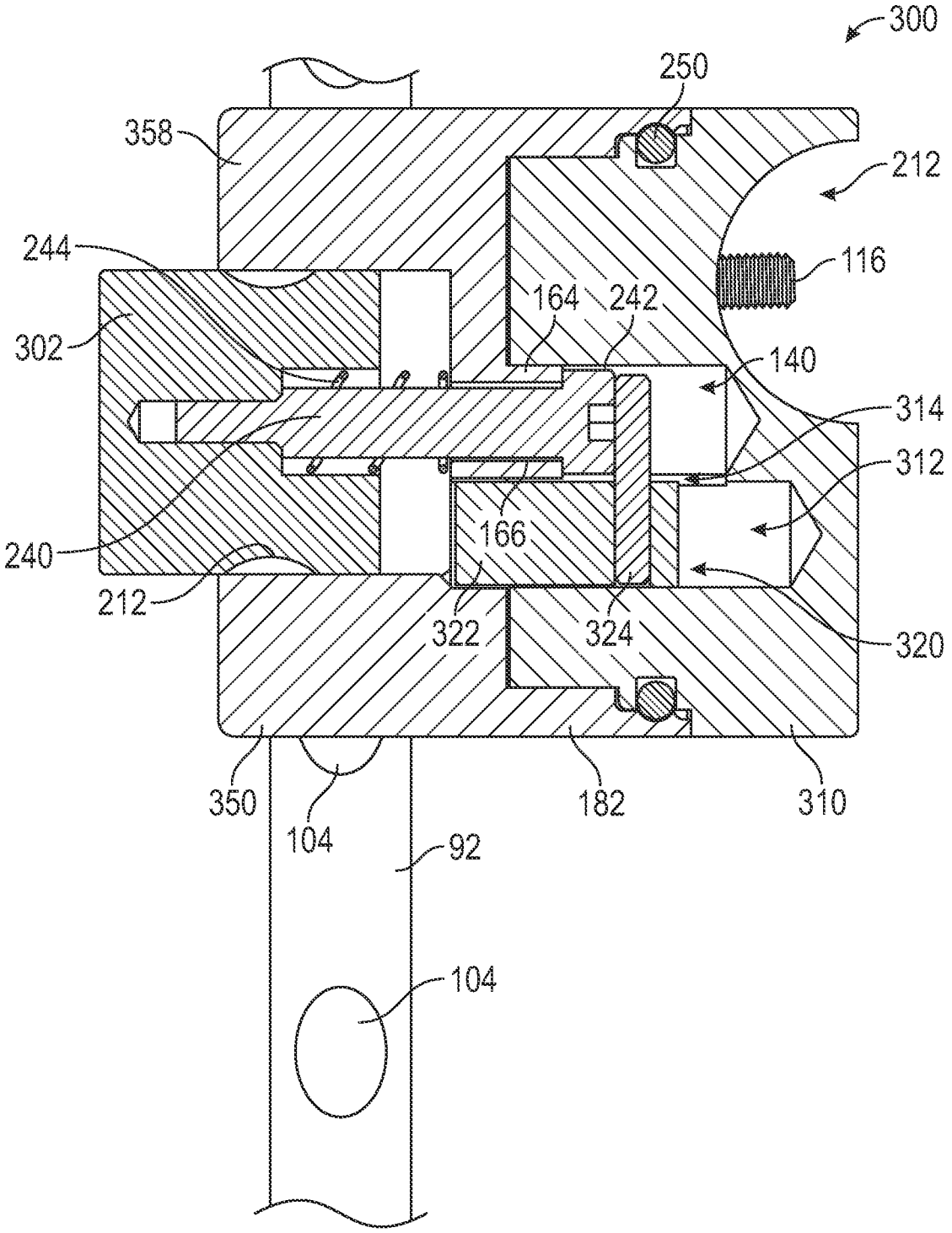
FIG. 25 is a section view of the free hinge assembly and the positioner assembly of FIG. 24.
Figure 26:
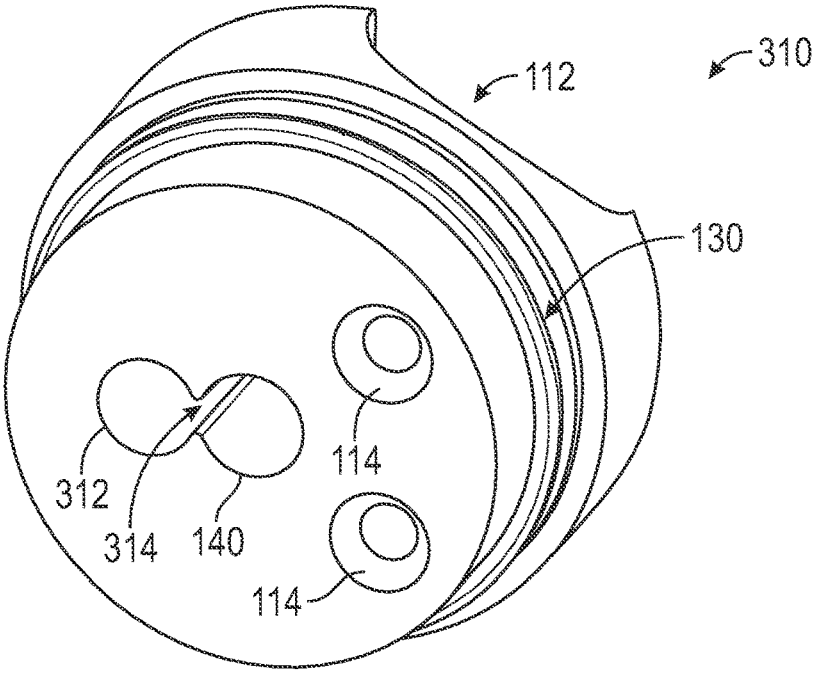
FIG. 26 is a perspective view of a base of the free hinge assembly of FIG. 24.
Figure 27:
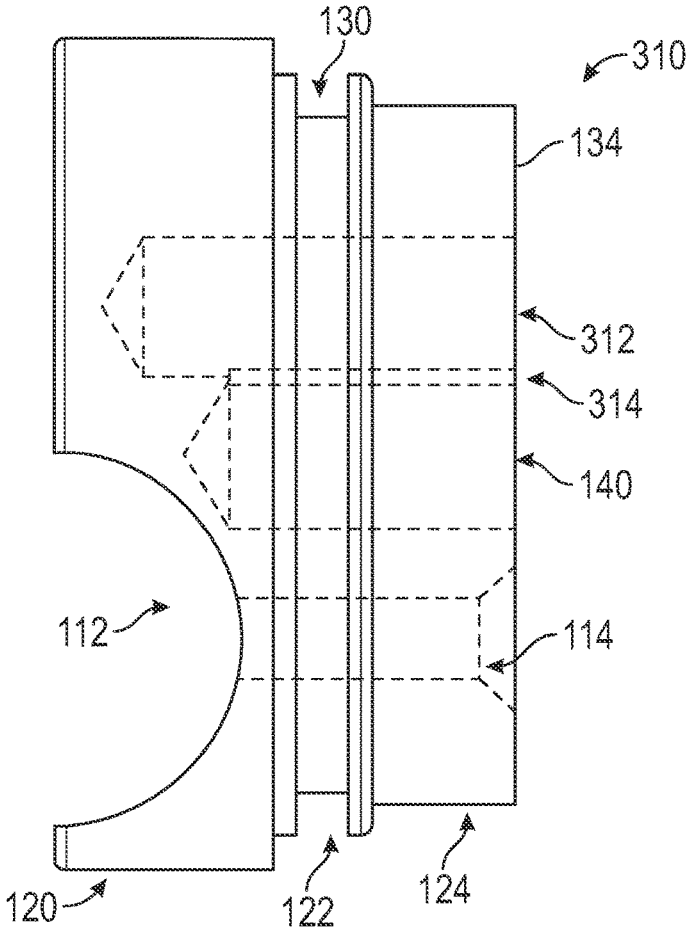
FIG. 27 is a top view of the base of FIG. 26.
Figure 28:
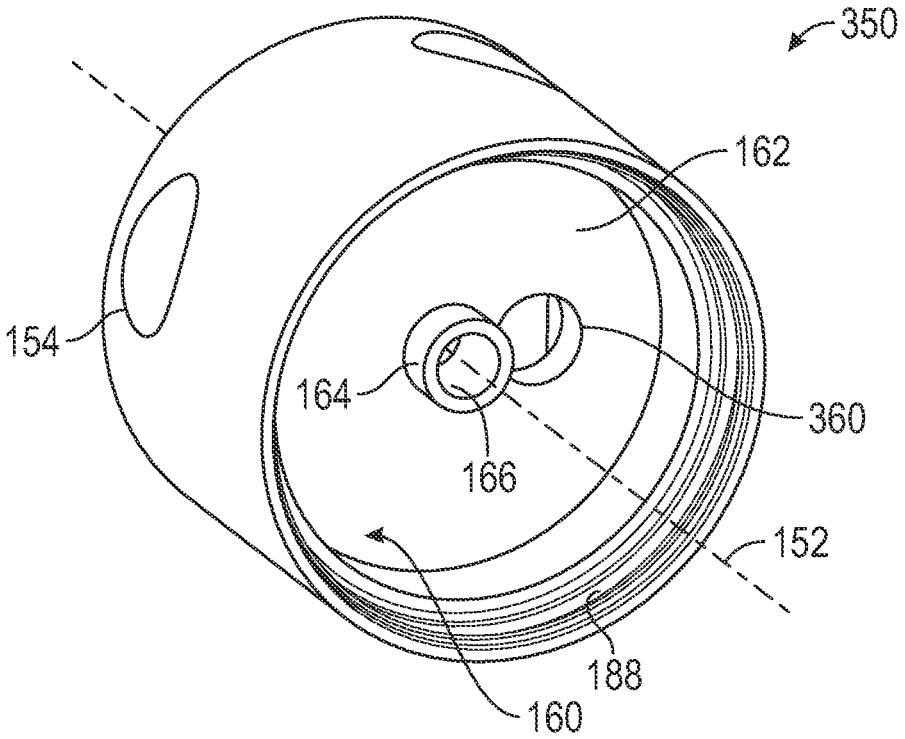
FIGS. 28 and 29 are perspective views of a cap of the free hinge assembly of FIG. 24.
Figure 29:
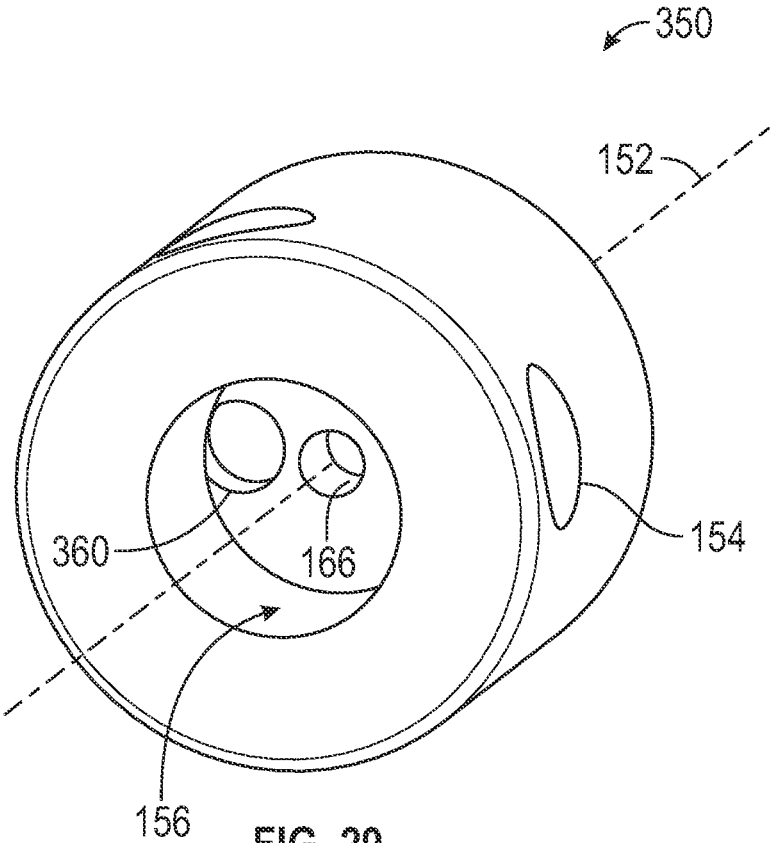

Referring to FIGS. 24 and 25, the free hinge 300 further includes a locking assembly, shown as bolt assembly 320. The bolt assembly 320 includes a first portion or shaft, shown as bolt 322. A link or arm, shown as pin 324, is coupled to the bolt 322. By way of example, the pin 324 may be pressed into an aperture defined by the bolt 322. The pin 324 extends perpendicular to the bolt 322.

During assembly, the bolt assembly 320 is inserted into the base 310. Specifically, the bolt 322 is inserted into the bolt recess 312. The pin 324 extends through the pin slot 314 and into the shaft recess 140. The pin 324 is positioned such that the pin 324 engages the head 242 of the shoulder bolt 240. In some embodiments, a biasing element (e.g., a compression spring) is positioned within the shaft recess 140 and/or the bolt recess 312 and configured to apply a biasing force on the bolt assembly 320 that biases the bolt assembly 320 toward the cap 350.

In operation, the bolt assembly 320 selectively limits (e.g., prevents) rotation of the cap 350 relative to the base 310 (e.g., locks the cap 350 in place). The bolt assembly 320 is repositionable between an extended position (shown in FIG. 25) and a retracted position. In the extended position, the bolt 322 extends into the bolt passage 360, limiting (e.g., preventing) rotation of the cap 350 relative to the base 310. The retracted position is offset inward from the extended position, such that the bolt 322 is disengaged from the bolt passage 360 and the cap 350 can rotate freely relative to the base 310. The bolt assembly 320 may be moved from the extended position to the retracted position by depressing the button 302. Specifically, by depressing the button 302, the head 242 of the shoulder bolt 240 engages the pin 324 and forces the bolt assembly 320 into the retracted position. The bolt assembly 320 may be biased back into the extended position by a biasing element.

The bolt passage 360 may be positioned to align with the bolt recess 312 when the free hinge 300 is in the rotational position corresponding to the buffet configuration and the intermediate raised configuration. Accordingly, the bolt assembly 320 may retain the shield assembly 80 in this rotational orientation until the button 302 is depressed. This may enhance the security of the shield assembly 80, ensuring that the shield assembly 80 cannot unintentionally fall from the buffet configuration or the intermediate raised configuration. When the free hinge 300 moves outside of this rotational orientation, the bolt assembly 320 may engage the divider wall 162. In this configuration, the cap 350 may rotate freely until the bolt passage 360 is again in alignment with the bolt recess 312. In other embodiments, the bolt assembly 320 is omitted from the free hinge 300, and the free hinge 300 does not lock the cap 350 in place.

Alternative System Configuration

Figure 30:
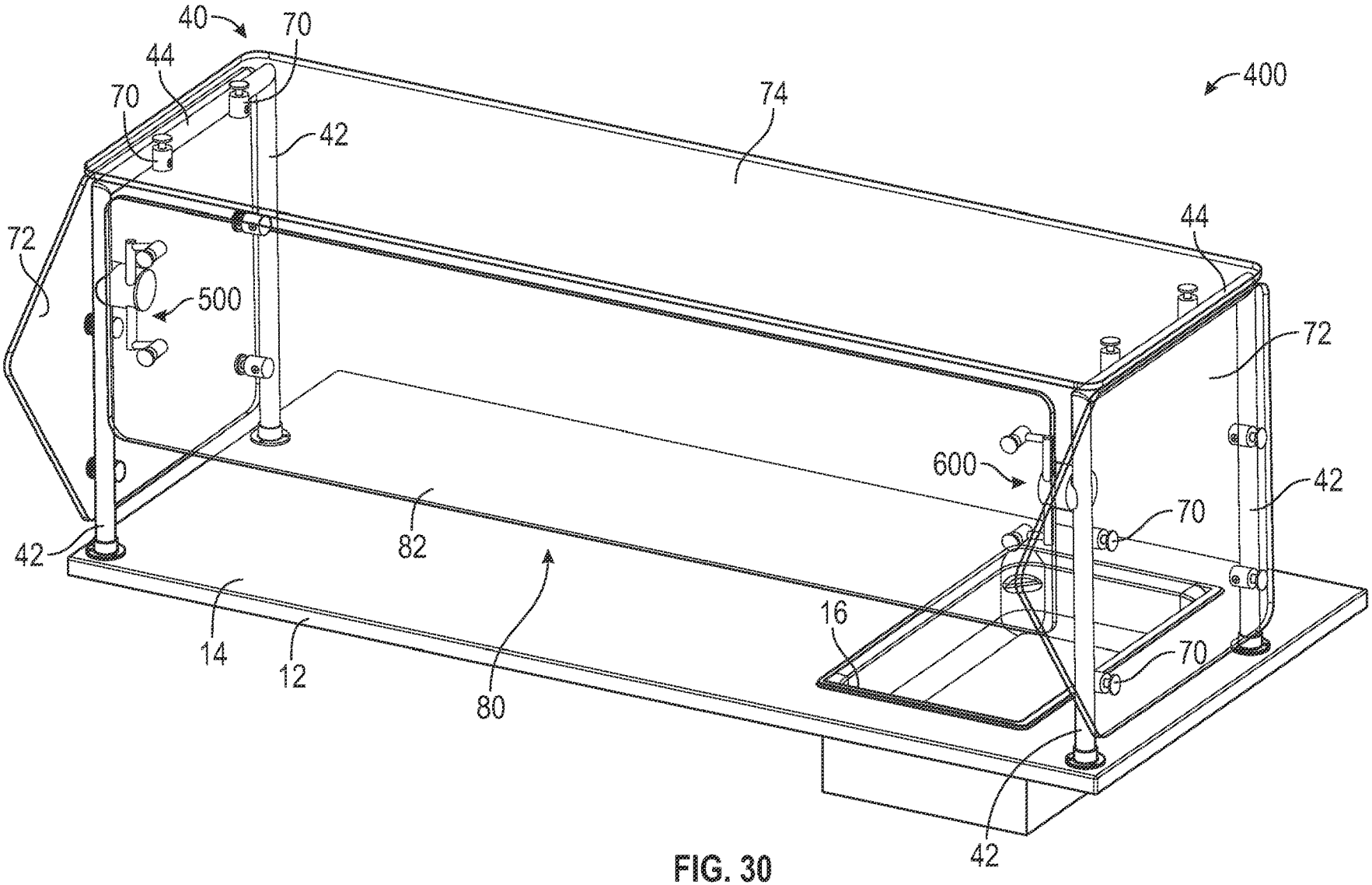
FIGS. 30 and 31 are perspective views of a food serving system including a breath guard having a shield assembly, according to another exemplary embodiment.
Figure 31:
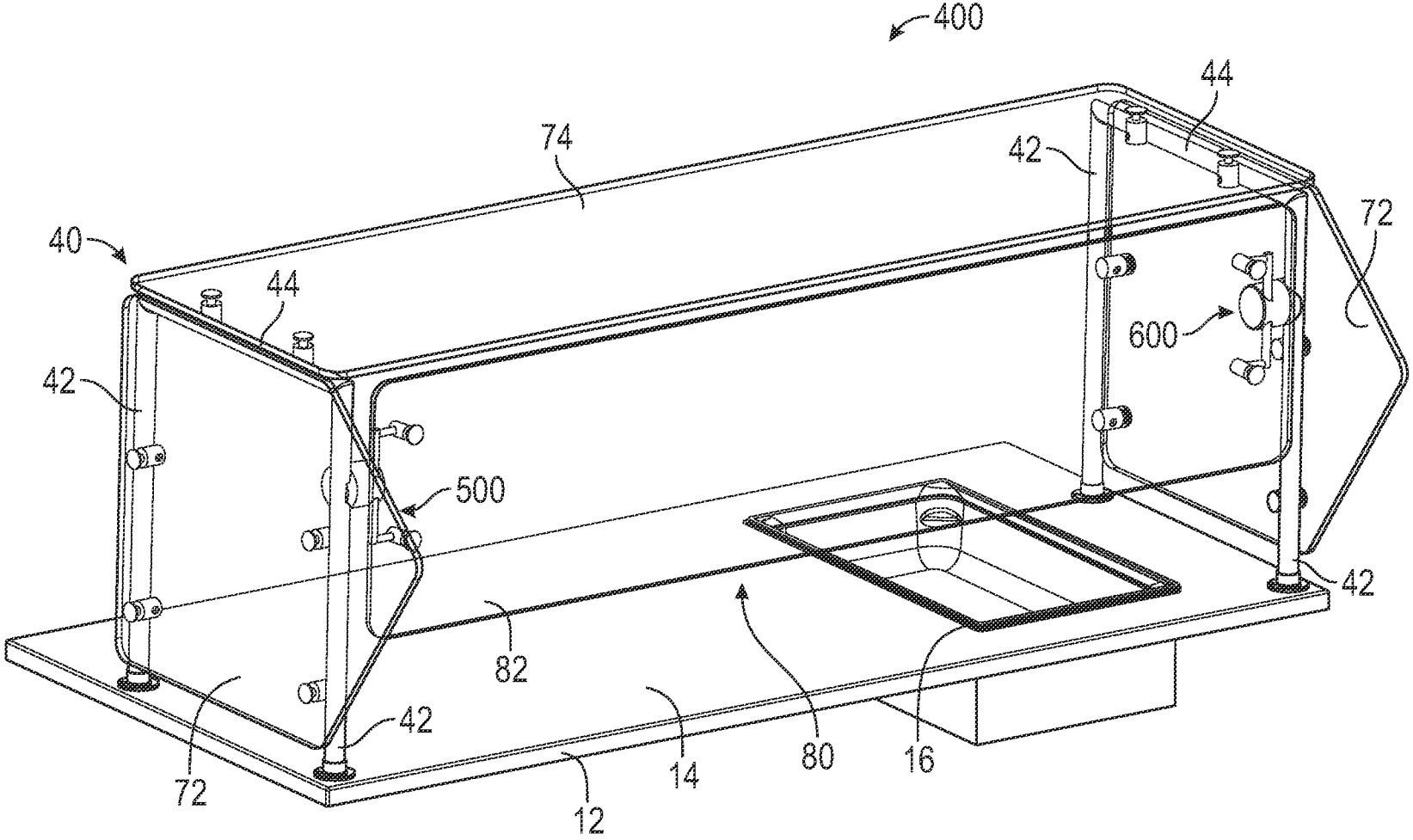

Referring to FIGS. 30 and 31, a food serving system, food storage system, or food display system is shown as system 400 according to an exemplary embodiment. The system 400 is an alternative embodiment of the system 10, and the system 400 may be substantially similar to the system 10 except as otherwise specified herein. The system 400 omits the lateral member 46, the longitudinal member 48, and the vertical member 50 of the frame 40. Instead, a single top panel 74 extends across the entire breath guard 30, coupling to both of the longitudinal members 44.

The shield assembly 80 of the system 400 extends across the entire breath guard 30, coupling to two of the vertical members 42. The shield assembly 80 of the system 400 includes a first hinge assembly, pivot, or positioner, shown as ratcheting hinge 500, and a second hinge assembly, pivot, or positioner, shown as free hinge 600, that movably (e.g., pivotally) couple the movable panel 82 to the frame 40. The ratcheting hinge 500 may be substantially similar to the ratcheting hinge 100 and the free hinge 600 may be substantially similar to the free hinge 100, except as otherwise specified herein. The ratcheting hinge 500 is coupled to one of the vertical members 42, and the free hinge 600 is coupled to another of the vertical members 42.

Figure 32:
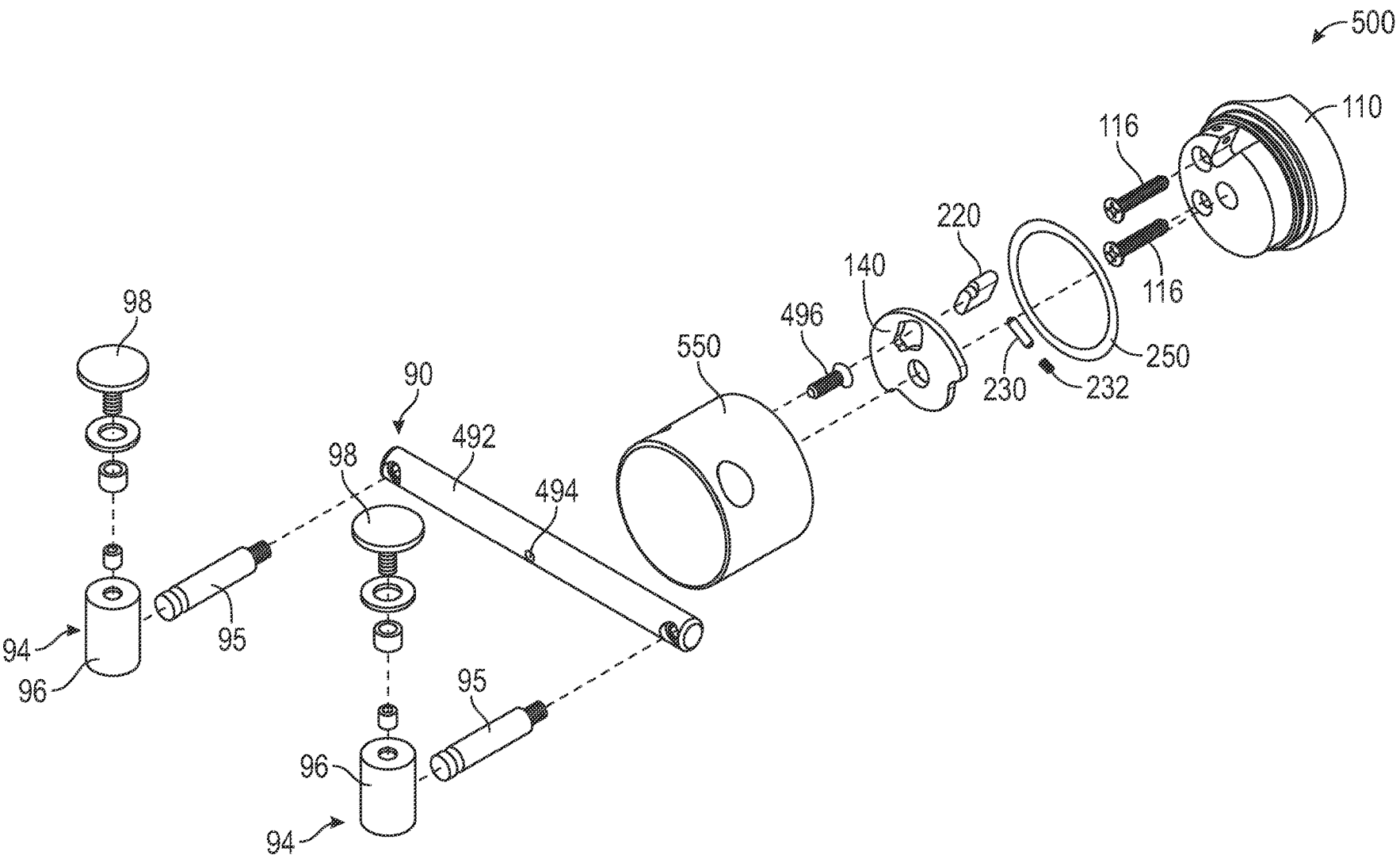
FIG. 32 is an exploded view of a ratcheting hinge assembly and a positioner assembly of the shield assembly of FIG. 30.
Figure 35:
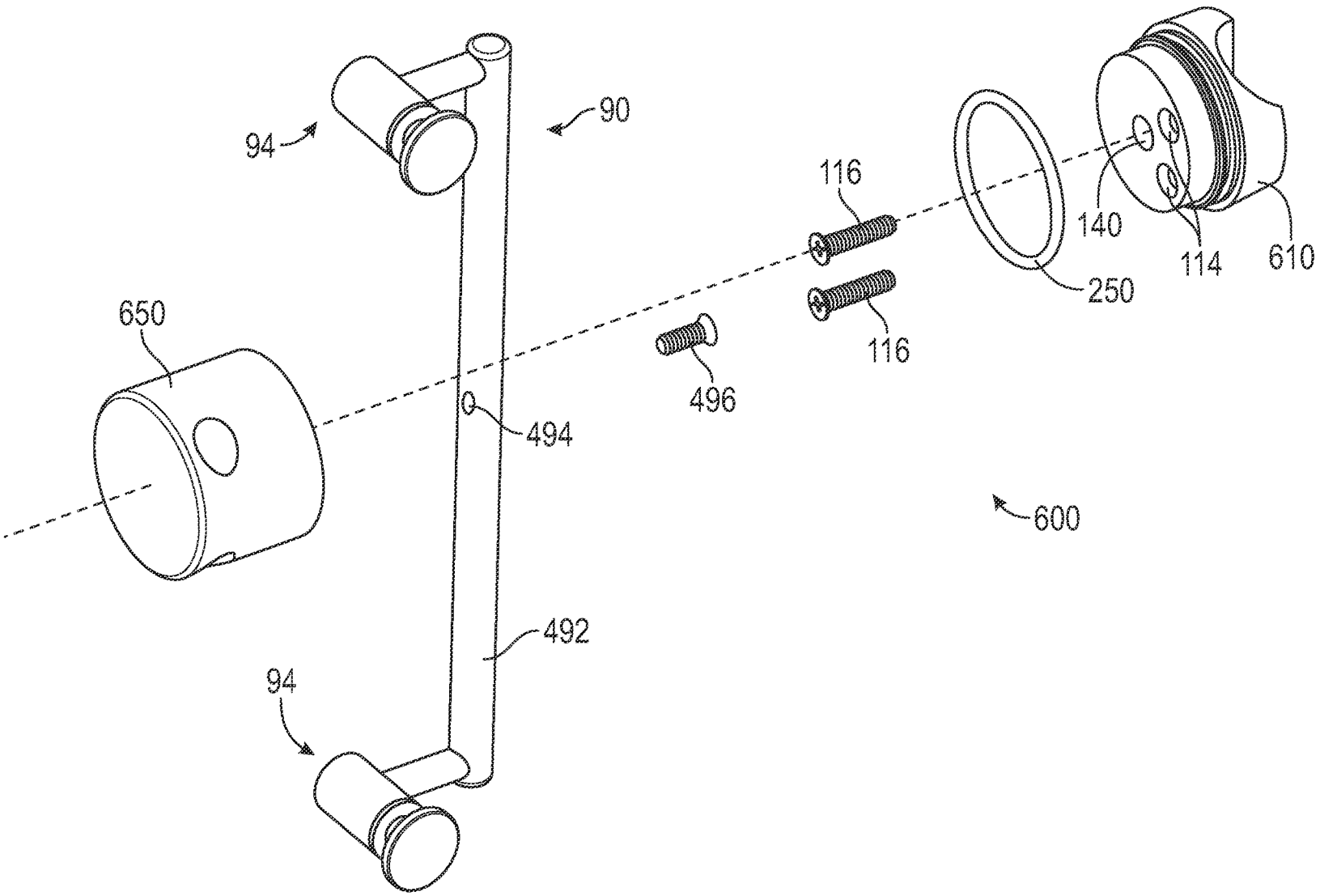
FIG. 35 is an exploded view of a free hinge assembly and a positioner assembly of the shield assembly of FIG. 30.

The ratcheting hinge 500 and the free hinge 600 permit pivotal adjustment of the movable shield 82, but not translational adjustment of the movable shield 82. Instead, the movable shield 82 is fixed relative to the ratcheting hinge 500 and the free hinge 600 by the corresponding positioner assemblies 90. Referring to FIGS. 32 and 35, the positioner assemblies 90 of the system 400 omit the arms 92 and instead include arms 492. The arms 492 may be substantially similar to the arms 92, except as otherwise specified herein. The arms 492 omit the scoops 104 of the arms 92. Instead, each arm 492 defines a threaded passage or aperture, shown as fastener passage 494. The fastener passage 494 extends perpendicular to the arm 492 and is approximately centered along the length of the arm 492. Each arm 492 is fixedly coupled to the corresponding hinge by a fastener or bolt, shown as arm fastener 496.

Figure 33:
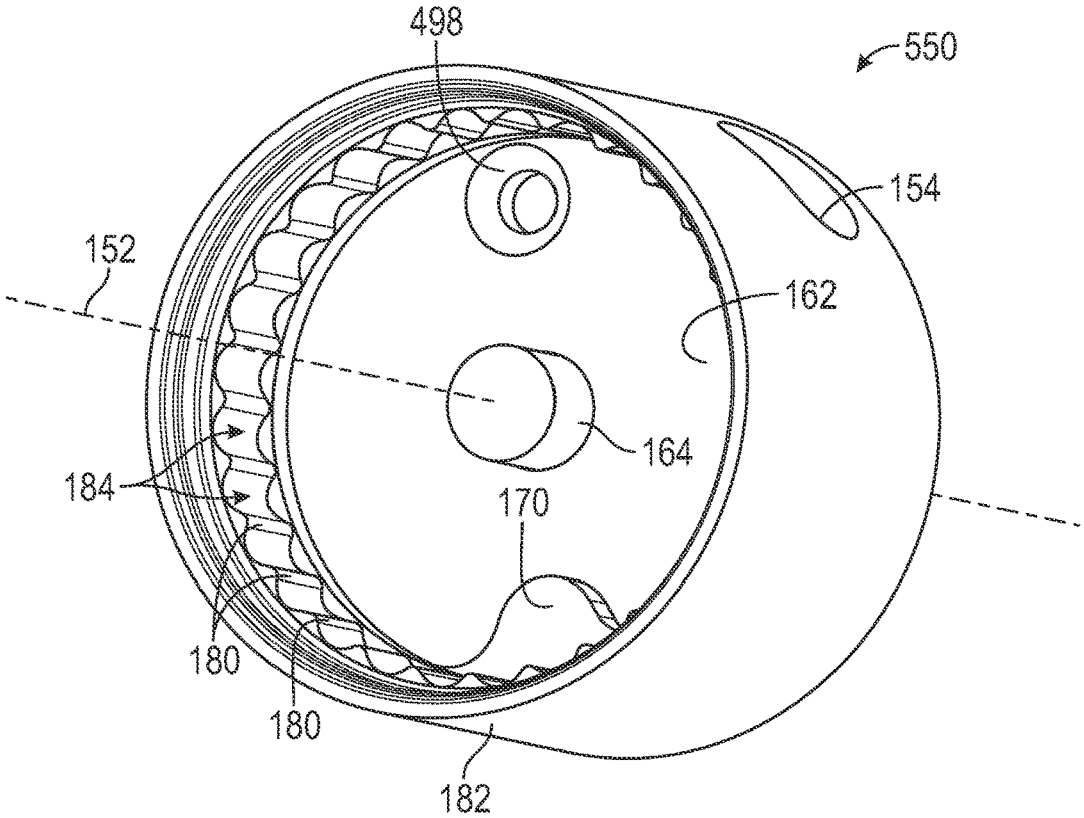
FIG. 33 is a perspective view of a cap of the ratcheting hinge assembly of FIG. 32.
Figure 34:
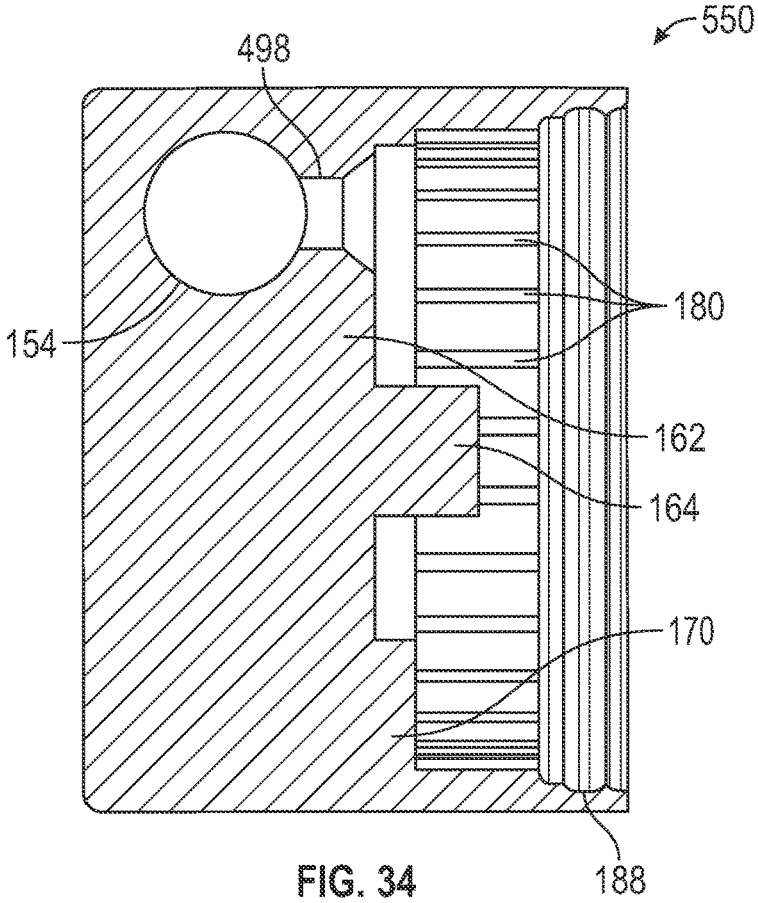
FIG. 34 is a left section view of the cap of FIG. 33.

Referring to FIGS. 32-34, the ratcheting hinge 500 and the corresponding positioner assembly 90 are shown according to an exemplary embodiment. The ratcheting hinge 500 omits the button 102 of the ratcheting hinge 100. The ratcheting hinge 500 includes a cylindrical cap portion, rotating portion, or connecting portion, shown as cap 550. The cap 550 may be substantially similar to the cap 150, except as otherwise specified herein. The cap 550 omits the button recess 156 and the fastener passage 166 of the cap 150. The cap 550 defines a passage, shown as fastener passage 498, that is configured to receive one of the arm fasteners 496. The fastener passage 498 may be aligned with the arm passage 154 such that the fastener passage 498 aligns with the fastener passage 494 of the corresponding arm 492 when the arm 492 is inserted into the arm passage 154. When the arm fastener 496 is inserted through the fastener passage 498 and the fastener passage 494, the arm fastener 496 fixes the arm 492 to the cap 550. The fastener passage 498 and the arm fastener 496 may have a corresponding countersunk profile such that the arm fastener 496 sits flush with or below the surface of the divider wall 162.

Figure 36:
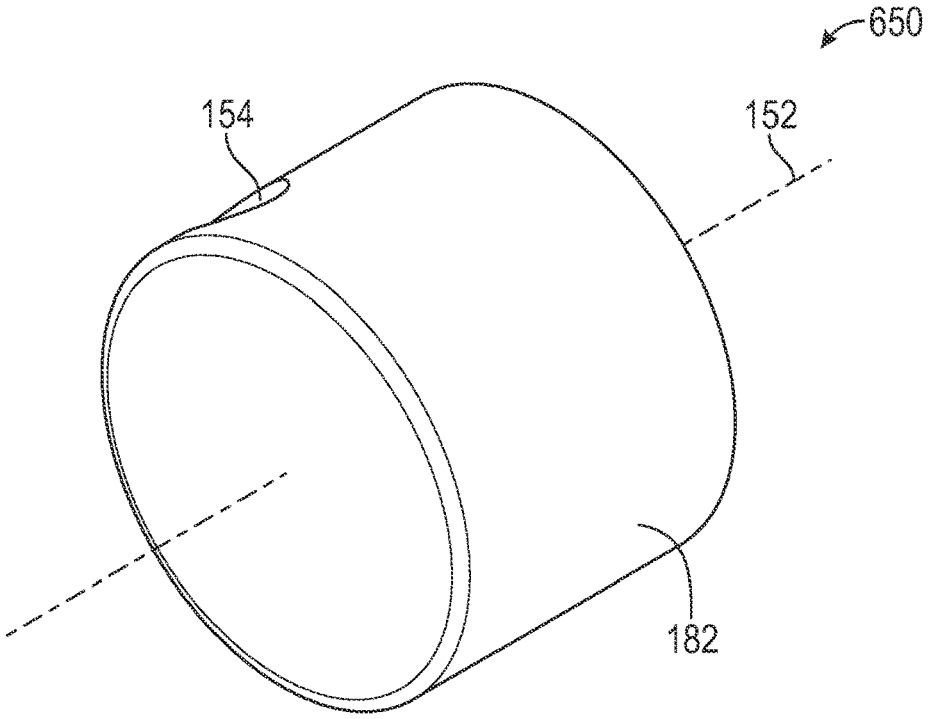
FIGS. 36 and 37 are perspective views of a cap of the free hinge assembly of FIG. 35.
Figure 37:
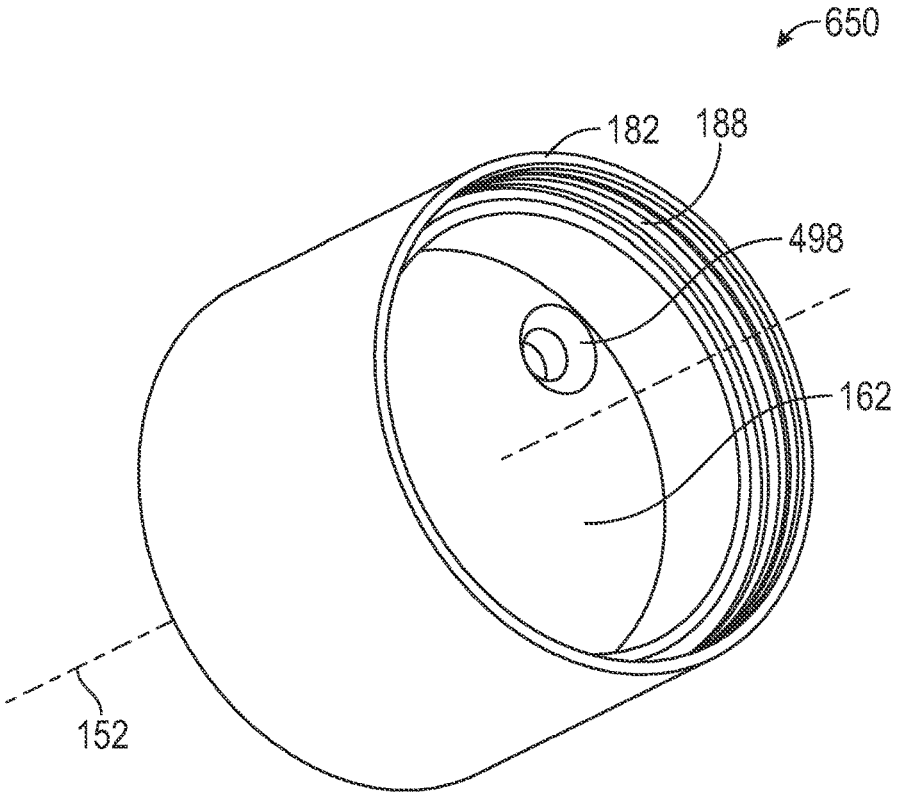

Referring to FIGS. 35-37, the ratcheting hinge 500 and the corresponding positioner assembly 90 are shown according to an exemplary embodiment. The free hinge 600 omits the button 302 and the bolt assembly 320 of the free hinge 300. The base 110 of the free hinge 600 omits the bolt recess 312 and the pin slot 314. The free hinge 600 includes a cylindrical cap portion, rotating portion, or connecting portion, shown as cap 650. The cap 650 may be substantially similar to the cap 350, except as otherwise specified herein. The cap 650 omits the button recess 156, the fastener passage 166, and the bolt passage 360 of the cap 150. The cap 650 defines a passage, shown as fastener passage 498, that is configured to receive one of the arm fasteners 496. The fastener passage 498 may be aligned with the arm passage 154 such that the fastener passage 498 aligns with the fastener passage 494 of the corresponding arm 492 when the arm 492 is inserted into the arm passage 154. When the arm fastener 496 is inserted through the fastener passage 498 and the fastener passage 494, the arm fastener 496 fixes the arm 492 to the cap 650. The fastener passage 498 and the arm fastener 496 may have a corresponding countersunk profile such that the arm fastener 496 sits flush with or below the surface of the divider wall 162.

As utilized herein with respect to numerical ranges, the terms "approximately," "about," "substantially," and similar terms generally mean+/−10% of the disclosed values. When the terms "approximately," "about," "substantially," and similar terms are applied to a structural feature (e.g., to describe its shape, size, orientation, direction, etc.), these terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. All such variations are within the scope of the disclosure.

It is important to note that the construction and arrangement of the system as shown in the various exemplary embodiments is illustrative only. Additionally, any element disclosed in one embodiment may be incorporated or utilized with any other embodiment disclosed herein. For example, the ratcheting hinge 500 of the exemplary embodiment shown in at least FIG. 32 may be incorporated in the system 10 of the exemplary embodiment shown in at least FIG. 1. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. An adjustable breath guard, comprising:
- a frame;
- a shield; and
- a hinge assembly pivotally coupling the shield to the frame, the hinge assembly comprising:
  - a base coupled to one of the frame or the shield;
  - a body coupled to the other of the frame or the shield and pivotally coupled to the base, the body defining a ratchet protrusion;
  - a pawl pivotally coupled to the base and repositionable between an extended position and a retracted position; and
  - a pawl retracting plate that is pivotally coupled to the base and repositionable between (a) a first position in which the pawl retracting plate engages the pawl and retains the pawl in the retracted position and (b) a second position in which the pawl retracting plate permits the pawl to move to the extended position,
- wherein the pawl is configured to engage the ratchet protrusion to limit rotation of the body relative to the base in a first rotational direction when the pawl is in the extended position, and wherein the pawl is separated from the ratchet protrusion in the retracted position such that the pawl permits rotation of the body in the first rotational direction.

2. The adjustable breath guard of claim 1, wherein the hinge assembly further comprises a biasing element configured to apply a biasing force that biases the pawl toward the extended position, and wherein the ratchet protrusion is configured to engage the pawl to move the pawl toward the retracted position when the body rotates in a second rotational direction opposite the first rotational direction.

3. The adjustable breath guard of claim 1, wherein the body further includes a protrusion positioned to engage a contact surface of the pawl retracting plate to move the pawl retracting plate into the first position in response to an upward movement of the shield.

4. The adjustable breath guard of claim 3, wherein the contact surface is a first contact surface, and wherein the protrusion is positioned to engage a second contact surface of the pawl retracting plate to move the pawl retracting plate into the second position in response to a downward movement of the shield.

5. The adjustable breath guard of claim 1, wherein the pawl retracting plate is positioned between the base and the body.

6. The adjustable breath guard of claim 5, wherein the body includes an annular wall that receives a portion of the base, and wherein the annular wall surrounds the pawl retracting plate.

7. The adjustable breath guard of claim 6, wherein the ratchet protrusion is a first ratchet protrusion of a plurality of ratchet protrusions of the body, and wherein the ratchet protrusions are positioned along an inner surface of the annular wall.

8. The adjustable breath guard of claim 1, further comprising an arm coupled to the shield, wherein the body defines an arm passage, and wherein the arm is received within the arm passage to slidably couple the shield to the body.

9. The adjustable breath guard of claim 8, wherein the hinge assembly further comprises a button slidably coupled to the body and defining a groove, wherein the arm defines a recess, wherein the button is repositionable between (a) a first position in which the button is received within the recess of the arm, limiting movement of the arm along the arm passage, and (b) a second position in which the groove aligns with the arm passage, permitting movement of the arm along the arm passage.

10. An adjustable breath guard, comprising:
- a frame;
- a shield;
- a hinge assembly including a button and pivotally coupling the shield to the frame; and
- an arm coupling the shield to the hinge assembly, wherein the arm is slidably coupled to the hinge assembly such that the shield is repositionable relative to the hinge assembly,
- wherein the hinge assembly is reconfigurable between (a) an engaged configuration in which the hinge assembly limits downward movement of the shield and permits upward movement of the shield and (b) a disengaged configuration in which the shield permits both downward movement of the shield and upward movement of the shield;
- wherein the hinge assembly is configured to change from the engaged configuration to the disengaged configuration in response to the shield moving upward; and
- wherein the hinge assembly is configured to limit movement of the arm relative to the hinge assembly in response to at least one of (a) a user pressing the button or (b) the user releasing the button, and wherein the hinge assembly is configured to permit movement of the arm relative to the hinge assembly in response to the other of (a) the user pressing the button or (b) the user releasing the button.

11. The adjustable breath guard of claim 10, wherein the hinge assembly is a first hinge assembly, further comprising a second hinge assembly pivotally coupling the shield to the frame, wherein the second hinge assembly permits both downward movement of the shield and upward movement of the shield.

* * * * *